US005979316A

United States Patent [19]

Baum

[11] Patent Number: 5,979,316

[45] Date of Patent: Nov. 9, 1999

[54] BELT-DRIVEN PRINTER-CUTTER MACHINE FOR CORRUGATED PAPERBOARD OF VARYING THICKNESS

[75] Inventor: Theodore M. Baum, Colona, Ill.

[73] Assignee: Corrugated Gear & Services, Inc., Alpharetta, Ga.

[21] Appl. No.: 08/940,454

[22] Filed: Sep. 30, 1997

[51] Int. Cl.[6] ..... B41F 5/00

[52] U.S. Cl. ..... 101/216; 101/248; 271/110; 493/8; 493/29

[58] Field of Search ..... 101/212, 216, 101/219, 233, 240, 241, 247, 248; 271/110, 118; 493/125, 147, 151, 201, 8, 13, 14, 15, 17, 18, 29

[56] References Cited

U.S. PATENT DOCUMENTS

| | | | |
|---|---|---|---|
| 2,847,214 | 8/1958 | Ritzerfeld et al. | 101/240 |
| 3,103,125 | 9/1963 | Dutro et al. | 101/248 |
| 3,763,775 | 10/1973 | Miles | 101/247 |
| 4,056,047 | 11/1977 | Grimm | 493/151 |
| 4,411,194 | 10/1983 | Davidson, Jr. | 101/216 |
| 4,565,129 | 1/1986 | Simeth et al. | 101/240 |
| 4,614,335 | 9/1986 | Sardella . | |
| 4,727,784 | 3/1988 | Sarva et al. | 271/22 |
| 5,186,103 | 2/1993 | Gelinas et al. | 101/247 |
| 5,421,258 | 6/1995 | Marozzi et al. | 101/247 |

OTHER PUBLICATIONS

Manufacturer's Specifications for the Hooper–Swift Model G–50 Flexographic Printer–Slotter.

*Primary Examiner*—Eugene Eickholt

*Attorney, Agent, or Firm*—Jones & Askew, LLP

[57] ABSTRACT

A disclosed embodiment of the invention is a belt-driven printer-cutter machine 10 including a roller-mounted feed/print machine section 14 and a fixed cutting machine section 16. A spline-type separable coupling 30–32 between these machine sections allows the feed/print section to be rolled on a fixed track 18 directly opposite the machine direction to separate the machine sections for maintenance, changing the printing plate 88 and cutting die 108, and to make other adjustments during machine setup. The sections may then be rolled back into engagement at the spline-type coupling to transmit power between the machine sections. The printer-cutter machine includes separate synchronous belts for the drive trains of each machine section. The machine may also include a separate synchronous belt for the fixed and adjustable rolls of each machine section. Specifically, the machine may include a dual auto-tensioned feed/print section belt 154, a fixed feed/print section belt 160, an auto-tensioned cutting section belt 230, and a fixed cutting section belt 244. Automatic belt take-up mechanisms 278, 282 driven by air cylinders 280, 284, automatically tension the synchronous belts 154, 230 driving the adjustable rolls of each machine section. This allows the nip between the upper and lower rolls of each machine section to be adjusted while maintaining constant machine speed and without affecting the proper registration between the machine sections and the leading edge of the paperboard blank.

23 Claims, 12 Drawing Sheets

(DETAIL VIEW OF AREA 5x)

(DETAIL VIEW OF AREA 4X)

BELT-DRIVEN PRINTER-CUTTER MACHINE FOR CORRUGATED PAPERBOARD OF VARYING THICKNESS

FIELD OF INVENTION

This invention relates to machines for manufacturing corrugated paperboard boxes and other products and, more particularly, to a belt-driven machine for printing and cutting corrugated paperboard blanks of varying thickness.

BACKGROUND

In conventional machines for manufacturing corrugated paperboard boxes, flat rectangular corrugated paperboard blanks advance in a horizontal machine direction through a printer-cutter machine, which performs diverse printing and cutting operations. The thickness of the paperboard blanks typically varies from approximately 1/16 to 3/8 inch (0.16 to 0.95 cm). The blanks are initially stacked onto a feed mechanism, which is typically integral with the feed/print section of printer-cutter machine. The feed mechanism feeds the blanks one-by-one into the feed nip of the feed/print section of the printer-cutter machine. The feed mechanism, such as that described in Sardella, U.S. Pat. No. 4,614,335, feeds the box blanks from the bottom of the stack to the nip of feed rolls. The blanks are accelerated to the machine speed of the feed rolls by the feed mechanism, which feeds the blanks in a precise, fixed, synchronized relationship with the rotating print and cutting rolls so that the leading edge of the each blank is fed to the feed roll nip for exactly one revolution of the print and cutting rolls. This allows the print and cutting rolls to be precisely positioned relative to the leading edge of each blank.

The feed rolls transport the blanks to the nip between the print roll and an impression roll. One or more printing plates attached to the print roll print an image onto the blank. The position of the printed image is precisely set relative to the leading edge of the blank. The blank next enters the nip between a pair of pull rolls that transport the blank to the nip between the cutting roll and an anvil roll. A cutting die or knives attached to the cutting roll cut the blank. Again, the position of the die cut is precisely set relative to the leading edge of the blank. The cutting roll feeds the blank out of the machine, completing the operation of the printer-cutter machine.

Other arrangements of these basic operations are sometimes provided. For example, the machine might utilize two printing rolls for two-color printing, provide additional pull rolls, or provide the ability to slot and score the blank using additional sets of slotting and scoring rolls. For each of these operations, the blank is fed between two rotating rolls and the position of the desired image or impression is precisely set relative to the leading edge of the blank.

In order to provide access to adjust the machine for changes in the width of the blank, and also to allow the printing plates and cutting dies to be changed, the printer-cutter machine is divided into sections in the machine direction. These sections are locked together during operation, but may be separated when the machine is idle to provide an operator with access to the interior of the machine for conducting maintenance, changing the printing plates and cutting dies, and making other adjustments during machine setup. Although a complex machine may include several machine sections, even a basic machine includes at least two main sections—a feed/print section and a cutting section.

The power source for a printer-cutter machine is usually a direct-current main drive motor, generally about 40 horsepower. The main drive motor drives the lower feed roll through a V-belt drive, which drives a sheave. The opposite end of the feed roll is fitted with a spur-type gear that acts as the main driver for a gear-driven drive train that drives all of the machine rolls in a synchronized cyclic relationship, so that printing and cutting are synchronized to the leading edge of each blank. Power is transferred between machine sections through the gear mesh of the mating spur-type gears in the drive train at the line of separation between the machine sections. These spur-type gears between the machine sections come out of mesh when the sections are separate and go back into mesh when the sections are returned to the operating position.

The width of the nip between the upper and lower rolls of the printer-cutter machine are typically adjustable to accommodate changes in the thickness of the blank. When adjusting the nip, it is important to maintain the proper surface speed of the nip rolls to maintain constant machine speed without affecting the proper registration between the machine sections and the leading edge of the paperboard blank. In addition, the spur-type gears must not come out of mesh when the nip is adjusted.

Most conventional gear-driven printer-cutter machines use some form of an "Oldham coupling" for this purpose. With this type of coupling, the nip may be adjusted to accommodate changes in the thickness of the corrugated paperboard while the machine transmits power at a constant velocity and maintains a tight mesh between mating gears. In addition, the nip is adjusted without affecting the synchronized relationship of printing and cutting relative to the leading edge of the blank. In other words, the nip can be adjusted while maintaining constant machine speed and without affecting the proper registration between the machine sections and the leading edge of the paperboard blank.

Gear-driven corrugated paperboard printer-cutter machines using Oldham couplings work well in many respects, but suffer from a number of disadvantages:

(a) The cost of manufacturing a new machine is high because the spur-type gears must be custom designed, hardened, and manufactured in relatively small production quantities.

(b) Backlash between mating gears increases with wear of the gear teeth. The backlash of each gear mesh is cumulative in the drive train, and thus tends to increase from the feeding mechanism, through the print roll, and to the cutting roll. Accordingly, the positional accuracy of the prints and cuts relative to the leading edge of the blanks, and relative to each other, deteriorates with the age of the gears of the drive train until the gears must be replaced.

(c) The cost of replacing worn gears is high because the hardened spur-type gears must be custom designed and manufactured in small production quantities. Because many manufacturers stock only the parts used on their current production models, replacement parts for many machines are manufactured on an individual-machine basis, further increasing the cost of the replacement parts. As a result, a complete gear-train replacement for a typical printer-cutter machine can cost hundreds of thousands of dollars.

(d) The Oldham couplings have oscillating components that must make one oscillation for each revolution of the coupled gear. The wear of these components exacerbates the gear-wear problem for conventional gear-driven printer-cutter machines. The additional backlash due to the wear of the Oldham coupling components is transferred to the associated driven roll. Accordingly, the positional accuracy of the prints and cuts relative to the leading edges of the blanks, and relative to each other, deteriorates with the age of the machine, until the Oldham coupling components must be replaced.

(e) The cost of replacing worn Oldham couplings is high, for the same reasons listed above for drive train gears, and contribute to the high cost of a complete gear-train replacement.

(f) Gear-driven drive trains and the associated Oldham couplings require lubrication and periodic oil changes.

(g) Gear-driven drive trains and the associated Oldham couplings for printer-cutter machines are custom designed and cannot use lower cost, mass produced, standard stock gears and couplings that are available at competitive prices.

(h) Gear-driven printer-cutter machines create high noise levels.

The S&S Corporation of Brooklyn, N.Y., manufactured gear-driven printer-cutter machines with stationary machine sections. Power was transmitted between machine sections by a stationary line shaft rigidly coupled to a stationary miter gearbox at each section. A spur-type gear mounted on the output of each miter gearbox provided the drive power for the gear-driven drive system for each machine section. The blanks were transported between the machine sections by a transfer assembly supported by the stationary machine sections. In the transfer assembly, the blanks were sandwiched between upper and lower synchronous belts to transport the blanks from one machine section to the next. Access to the machine sections for maintenance and setup was provided by a pit dug into the floor below the transfer assembly. This rather cumbersome design was abandoned about twenty years ago in favor of the conventional gear-driven Oldham coupling arrangement with separable machine sections described previously.

Accordingly, there is a need for a low-cost printer-cutter machine with separable machine sections that avoids the costs associated with a gear-driven drive train. There is a further need for a low-cost printer-cutter machine in which the nip between opposing rolls may be adjusted while maintaining constant machine speed and without affecting the proper registration between the machine sections and the leading edge of the paperboard blank.

SUMMARY OF THE INVENTION

The present invention is a belt-driven printer-cutter machine including a separable, rotatary power transfer coupling apparatus between a fixed machine section and a movable machine section. The separable coupling allows the sections to be separated for set-up and maintenance, and then joined to couple power transmission between the machine sections. The machine includes separate synchronous belts for driving each machine section. The machine may also include separate synchronous belts for driving the fixed and adjustable rolls of each machine section. Automatic belt take-up mechanisms automatically tension the synchronous belts driving the adjustable rolls of each machine section and allow the nip between the upper and lower rolls of each machine section to be adjusted while maintaining constant machine speed and without affecting the proper registration between the machine sections and the leading edge of the paperboard blank. This configuration results in many advantages over conventional gear-drive printer-cutter machines including a lower cost machine that is composed almost entirely of mass-produced stock commercial components that are available at competitive prices. In particular, the drive train components that experience normal wear consist of low cost, stock, commercial synchronous belts. The construction of the machine is simpler, requires no lubrication, and has a low noise level.

Generally described, the invention is belt-driven machine for operating on a plurality of blanks, each blank defining a leading edge. A feed mechanism feeds each blank in a machine direction. A first machine section driven by a first synchronous belt receives each blank from the feed mechanism and performs a first operation on each blank. The first synchronous belt synchronizes the performance of the first operation with the position of the leading edge of each blank. A second machine section driven by a second synchronous belt receives each blank from the first machine section and performs a second operation on each blank. A separable coupling selectively transmits rotational power from the first machine section to the second machine section and synchronizes the performance of the second operation with the position of the leading edge of each blank. The feed mechanism may be driven by a synchronous feed-mechanism belt, and a coupled-set of synchronous belt sprockets may synchronously couple the rotational power source to the synchronous feed-mechanism belt and to the first synchronous belt to synchronize the performance of the first operation with the position of the leading edge of each blank.

According to an aspect of the invention, the automatic take-up includes a pivoting arm and a movable tension roller rotatably attached to an end of the pivoting arm. The movable tension roller is positioned to maintain the tension in an associated synchronous belt as the pivoting arm pivots. An actuator attached to an opposing end of the pivoting arm automatically moves the opposing end of the first pivoting arm in response to changes in tension of the synchronous belt.

More specifically described, the invention is a belt-driven machine for operating on a plurality of blanks, each blank defining a leading edge. A feed mechanism, which is driven by a synchronous feed-mechanism belt, couples rotational power from a rotational power source to feed the blanks in a machine direction. A first machine section includes a first frame, a rotating first upper roll, and an rotating first lower roll defining a first nip for transporting each blank through the first machine section and performing a first operation on each blank. The first machine section also includes a first adjustment mechanism for adjusting the position of the first upper roll with respect to the first frame to adjust the first nip to accommodate blanks of varying thickness. The first machine section also includes a first synchronous belt driving the first upper roll, and a third synchronous belt driving the first lower roll so that adjustment of the first nip does not alter the position of the first operation with respect to the leading edge of each blank. A first automatic take-up automatically maintains tension in the first synchronous belt in response to adjustment of the first nip. A coupled-set of synchronous belt sprockets synchronously couples the rotational power source to the synchronous feed-mechanism belt and to the first synchronous belt to synchronize the performance of the first operation with the position of the leading edge of each blank.

A second machine section includes a second frame, a rotating second upper roll, and a rotating second lower roll defining a second nip for transporting each blank through the second machine section and performing the second operation on each blank. The second machine section also includes a second adjustment mechanism for adjusting the position of the second lower roll to adjust the second nip to accommodate blanks of varying thickness. The second machine section also includes a second synchronous belt driving the second lower roll, and a fourth synchronous belt driving the second upper roll so that adjustment of the second nip does not alter the position of the second operation with respect to the leading edge of each blank. A second automatic take-up automatically maintains tension in the second synchronous belt in response to adjustment of the second nip. A separable coupling rotates in the cross-machine direction to selectively transmit rotational power from the first machine section to the second machine section and to synchronize the performance of the second operation with the position of the leading edge of each blank.

A first right-angle transmission is configured to transmit rotational power in the machine direction at a first input shaft to rotational power in the cross-machine direction at a first output shaft. The first input shaft is coupled to the third synchronous belt, and the first output shaft is coupled to the separable coupling. A second right-angle transmission is configured to transmit rotational power in the cross-machine direction at a second input shaft to rotational power in the machine direction at a second output shaft, and to rotational power in the cross-machine direction at a third output shaft. The second input shaft is coupled to the separable coupling, and the second output shaft is coupled to the second synchronous belt. A third right-angle transmission is configured to transmit rotational power in the cross-machine direction at a third input shaft to rotational power in the machine direction at a fourth output shaft. The third input shaft is coupled to the third output shaft, and the fourth output shaft is coupled to the fourth synchronous belt.

A separation facilitator accommodates separation of the first and second machine sections at the separable coupling. The separation facilitator may include free-wheeling rollers supporting one of the machine sections and a linear track for rotatably guiding the rollers to facilitate moving that machine section into and out of engagement with the other machine section. For example, the separation facilitator may include free-wheeling rollers supporting the first machine section and a linear track for rotatably guiding the rollers to facilitate moving the first machine section opposite the machine direction to separate the first machine section from the second machine section. This separation facilitator also accommodates moving the first machine section in the machine direction to join the first machine section to the second machine section at the separable coupling.

Typically, the first operation involves printing and the second operation involves cutting. In this case, the first upper roll is an impression roll, the first lower roll is a print roll, the second upper roll is a cutting roll, and the second lower roll is an anvil roll. The first machine section of this typical configuration also includes an upper feed roll driven by the first synchronous belt, a lower feed roll driven by the first synchronous belt, and a third nip defined by the upper feed roll and the lower feed roll for transporting each blank from the feed mechanism to the first nip. The second machine section of this typical configuration also includes a lower pull roll driven by the second synchronous belt, an upper pull roll driven by the fourth synchronous belt, and a fourth nip defined by the upper pull roll and the lower pull roll for transporting each blank from the first nip to the second nip.

Thus, it is an object of the invention to provide a low-cost printer-cutter machine that avoids the costs associated with a gear-driven drive train. It is a further object of the invention to provide a belt-driven printer-cutter machine in which the machine sections may be separated for set-up and maintenance, and then joined to couple power transmission between the machine sections. And it is a further object of the invention to provide a belt-driven printer-cutter machine in which the nip between opposing rolls may be adjusted while maintaining constant machine speed and without affecting the proper registration between the machine sections and the leading edge of the paperboard blank.

Additional features and advantages of the invention will become apparent from the following detailed description of the preferred embodiments and the appended drawings and claims.

DETAILED DESCRIPTION OF THE PREFERRED EMBODIMENTS

Figure 1:
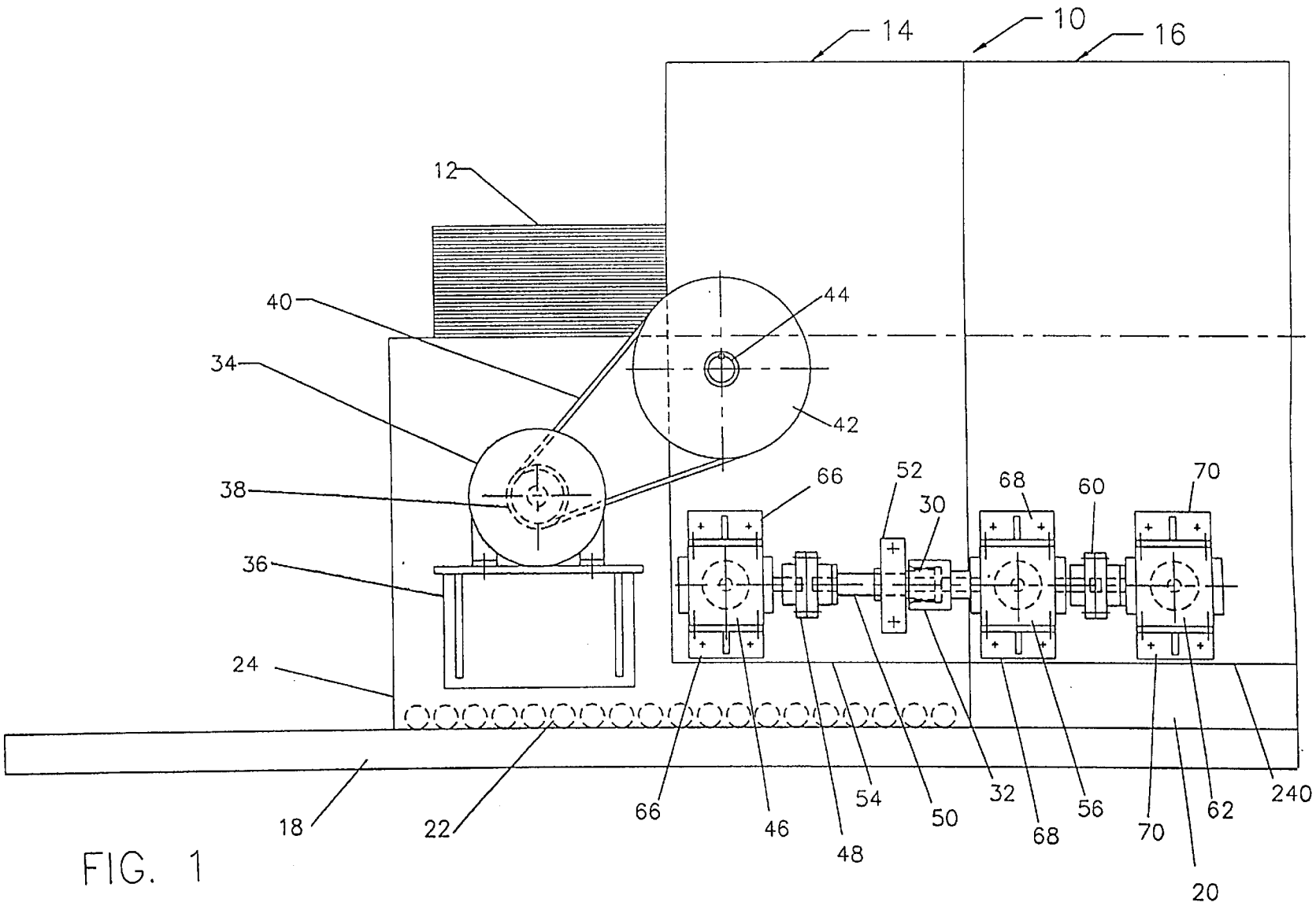
FIG. 1 is a right side elevation view of a printer-cutter machine with machine sections in their operating position.

A disclosed embodiment of the invention is a belt-driven printer-cutter machine including a movable feed/print machine section and a fixed cutting machine section. A conventional separation facilitator, such as free-wheeling rollers supporting the feed/print machine section and fixed linear tracks for guiding the rollers, accommodates movement of the feed/print machine section into and out of engagement with the cutting machine section. A separable, rotary power transmission coupling apparatus between these machine sections, such as a spline-type coupling having an inner cuff that slidably engages with an outer cuff or a miter gearbox, allows the feed/print section to be easily rolled on the track directly opposite the machine direction to separate the machine sections for maintenance, changing the printing plates and cutting dies, and making other adjustments during machine setup.

The sections may then be rolled back into engagement at the spline-type coupling to transmit power between, and synchronize the operation of, the machine sections. Specifically, rotational power in the machine direction is initially delivered to the feed/print section by a rotational power source, such as a main drive electric motor or other suitable rotational power source. A feed/print section right-angel transmission, such as a first miter gearbox driven by the feed/print section, transmits this rotational power in the machine direction to rotational power in the cross-machine direction. The spline-type coupling rotates in the cross-machine direction to separably couple the rotational power from the feed/print machine section to a pair of right-angel transmissions for the cutting machine section, such as second and third miter gearboxes. These second and third miter gearboxes transmit the rotational power in the cross-machine to rotational power in the machine direction to drive the cutting machine section.

The printer-cutter machine includes separate synchronous belts for the drive trains of each machine section. The machine may also include separate synchronous belts for the fixed and adjustable rolls of each machine section. Specifically, the feed/print machine section may include a first synchronous belt driving an adjustable upper impression roll, an adjustable lower flexographic ink-applying roll, and an adjustable upper feed roll. The cutting machine section may include a second synchronous belt driven by a torque shaft coupled to the second miter gearbox and driving an adjustable lower pull roll and an adjustable lower anvil roll of the cutting machine section. The feed/print machine section may also include a third synchronous belt driven by a fixed lower feed roll and driving a fixed lower print roll and the first miter gearbox. And the cutting machine section may include a fourth synchronous belt driven by the third miter gearbox and driving a fixed upper pull roll and a fixed upper cutting roll.

The feed mechanism may be driven by a synchronous feed-mechanism belt, and a coupled-set of synchronous belt sprockets mounted on the lower feed roll synchronously couples the rotational power source to the feed-mechanism belt and to the first synchronous belt to synchronize the performance of the first operation with the position of the leading edge of each blank. Automatic belt take-up mechanisms, tensioned by actuators such as air cylinders, automatically tension the synchronous belts driving the adjustable rolls of each machine section and allow the nip between the upper and lower rolls of each machine section to be adjusted while maintaining constant machine speed of the adjustable rolls and without affecting the proper registration between the machine sections and the leading edge of the paperboard blank.

Although the machine is described as including a first machine section for printing the blanks and a second machine section for cutting the blanks, the first machine section could equivalently be operable for cutting the blanks and the second machine section could equivalently be operable for printing the blanks. In addition, both machine sections could equivalently be operable for printing, as may be desirable for a two-color printing machine. Many other configurations are also possible in accordance with the teaching of the invention. For example, the feed mechanism fixed drive synchronous belt and the print apparatus fixed drive synchronous belt could be disposed in separate machine sections, or an additional color print section could be included, slotting and scoring sections could be added, and so forth.

It should be understood, therefore, that both machine sections could equivalently be operable for cutting or scoring, as may be desirable for a machine for cutting hand holds and/or windows, as well as impressing perforations and/or score lines. In addition, more than two machine sections could be separably connected in series to construct a more complicated machine, as may be desirable for a two-color printing machine that is operable for cutting hand holds and/or windows, as well as impressing perforations and/or score lines. Many other operations, such as synchronized folding, bending, perforating, affixing labels, painting, affixing an outer film, and so forth could also be performed by additional machine sections in accordance with the teaching of the present invention.

Although the actuators of the automatic take-up mechanisms are described as air cylinders, many other types of actuators could equivalently be used, such as hydraulic pistons, electric servo-motors, rotating ball screws carrying captured ball-bearing nuts, pulleys and cables, chains and sprockets, springs, levers, elastic connectors, and the like. Similarly, although the roll nip adjustment mechanisms are described as spur-type gears and eccentric gear housings, many other types of adjustment mechanisms could equivalently be used, such as spur-type gears and eccentric gear housings, manual or motorized spur-type gears and linear toothed tracks, hydraulic pistons, air cylinders, electric servo-motors, rotating ball screws carrying captured ball-bearing nuts, and the like. Furthermore, although the separating facilitator is described as free-wheeling rollers guided by a fixed linear track, many other types of separation facilitators could equivalently be used to separate the machine sections, such as a rotating tread, a lubricated junction, a motorized platform, a tilting table, a jack, a lifting or lowering mechanism, a swiveling table, and so forth. And, although the separable coupling is described as a spline-type coupling, many other separable couplings could equivalently be used, such as bolted plates, removable pins, a threaded engagement, mating eccentric flanges, a pawl and sprocket, gear couplings, toothed couplings, and the like.

Structure Of A Printer-Cutter Machine With Fixed And Adjustable Rolls Driven By Separate Belts FIG. 1 is a right side elevation view of a belt-driven printer-cutter machine 10 according to an embodiment of the present invention. The printer-cutter machine 10 is operational for sequentially feeding a series of corrugated paperboard blanks fed from the bottom of the stack of blanks 12 through the machine to print and cut each blank. As used herein, "rotation in the machine direction" means rotation about an axis of rotation that extends in the cross-machine direction, which is orthogonal into the elevation view of FIG. 1. Conversely, "rotation in the cross-machine direction" means rotation about an axis of rotation that extends in the machine direction, which is from left to right in FIG. 1.

Thus, blanks travel through the machine 10 in the machine direction, and the various feeding, printing, and cutting rolls rotate in the machine direction. The printer-cutter machine 10 includes of a feed/print section 14 and a cutter section 16. Both machine sections are mounted to and supported by a fixed linear track 18, which extends in the direction of machine flow. The fixed track 18 is typically rigidly secured to a floor or foundation by foundation bolts or other suitable anchoring means. It should be appreciated that, although the machine 10 is specifically designed for printing and cutting corrugated paperboard blanks of varying thicknesses, it may be adapted to printing and cutting blanks made from other materials, such as cloth, plastic, wood, fiberglass, composite materials, and so forth.

The bottom of the cutter machine section 16, represented by the right side cutter frame 20, is rigidly mounted to the track 18 so that the cutter machine section does not move with respect to the track, for example by welds or bolts. The feed/print section 14, on the other hand, is slidably mounted to the track 18. Specifically, a plurality of free-wheeling rollers 22 are rotatably mounted to the feed/print section 14, represented by the right side feed/print frame 24. The rollers 22 may roll within the track 18 so that the feed/print section may be rolled on the track 18 directly opposite the machine direction to separate the machine sections. A similar arrangement, not shown, supports a left side feed/print frame 26 and a left side cutter frame 28 on the opposite side of the machine 10. Although the feed/print section 14 is shown as the movable machine section and the cutting section 16 is shown as the stationary section, it will be appreciate that the feed/print section 14 could equivalently be the stationary machine section and the cutting section 16 could equivalently be the movable machine section.

Figure 2:
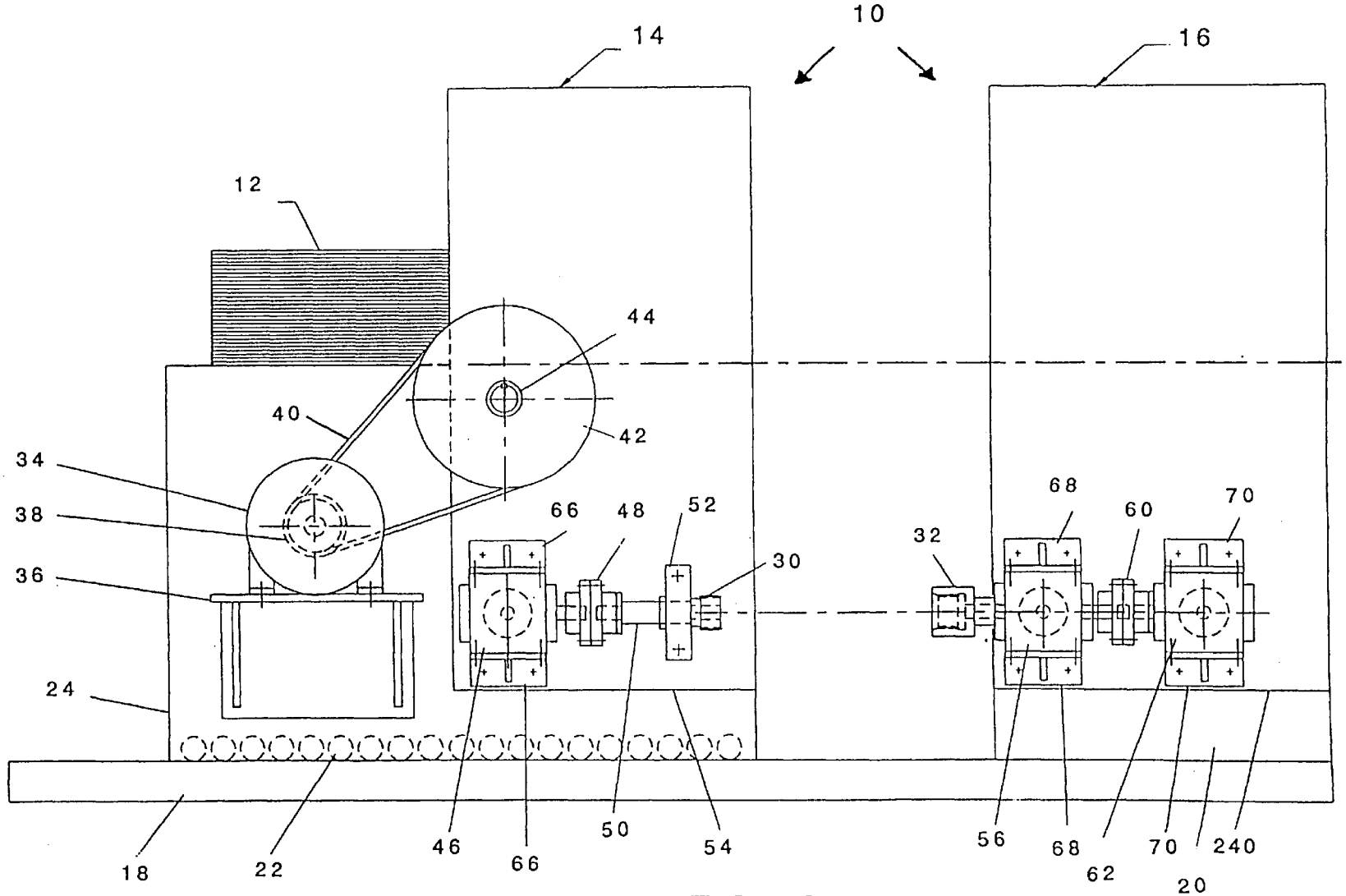
FIG. 2 is a right side elevation view of the printer-cutter machine with the machine sections separated and in their inoperative set-up position.

FIG. 2 is a right side elevation view of the printer-cutter machine 10 with the machine sections in a separated position, which is used for maintenance and machine setup. The feed/print machine 14 is connected to the cutter machine section 16 by a separable coupling, such as a slidably separating spline-type coupling 30–32, so that the feed/print machine 14 may be easily moved from the closed position shown in FIG. 1 to the open position shown in FIG. 2. From the separated or open position, the feed/print section 14 may be rolled in the machine direction to bring the internal cuff 30 of the spline-type coupling, which is mounted on the feed/print machine section 14, into engagement with the external cuff 32 of the spline-type coupling, which is mounted on the cutter section 16. This places the machine 10 in the operational position, as shown in FIG. 1. To access the interior of the machine 10, the feed/print section 14 may be rolled opposite the machine direction to disengage the cutter section 16 from the feed/print section 14 at the spline-type coupling 30–32. The apparatus for moving the machine section 14, which typically includes a motorized gear and a toothed track or an equivalent linear actuator, is not shown because it is well known to those skilled in the art Power Transmission System A main drive motor 34 is supported by a motor support bracket 36. The motor support bracket 36 is supported by the right side feed/print frame 24. A V-belt sheave 38 is mounted on the shaft of the motor 34. A V-belt 40 connects the sheave 38 to a V-belt driven sheave 42, which drives a lower feed roll 44 of the feed/print section 14. The main drive motor 34, the V-belt sheave 38, driven sheave 42, and the lower feed roll 44 rotate in the machine direction. To couple the drive force between the machine sections, a first miter gearbox 46 coupled to the feed/print section 14 operates as a right-angle transmission to convert the rotational force of the feed/print section 14 in the machine direction to rotational force in the cross-machine direction.

The first miter gearbox 46 rotates in the cross-machine direction to drive a rigid shaft coupling 48, which couples the rotational power to a stub shaft 50, which couples the rotational power to a pillow block 52. The pillow block 52 is supported by a guard 54. The pillow block drives the inner cuff 30 of the spline-type coupling 30–32. The inner cuff 30 serves as a rotary power transfer device for the feed/print machine section 14. The inner cuff 30 may be separably coupled to the outer cuff 32, which serves as a rotary power transfer device for the cutting machine section 16. Thus, the spline-type coupling 30–32 couples the rotational power between the feed/print machine section 14 and the cutting section 16 when the machine sections are in the closed position, as shown in FIG. 1. The outer cuff 32 of the spline-type coupling 30–32 drives a second miter gearbox 56, which operates as a right-angle transmission to convert the rotational force of the outer cuff 32 in the cross-machine direction to rotational force in the machine direction to drive an anvil roll 58 of the cutting section 16 of the machine. The belt-drive system for coupling the anvil roll 58 to the second miter gearbox 56 is shown best in FIGS. 8 and 11.

The second miter gearbox 56 also couples the rotational force of the outer cuff 32 of the spline-type coupling 30–32 to rotational force in the cross-machine direction to drive a rigid shaft coupling 60 that couples the rotational power to a third miter gearbox 62, which operates as a right-angle transmission to convert the rotational force of the outer cuff 32 in the machine direction to rotational force in the cross-machine direction to drive a cutting roll 64 of the cutting section 16 of the machine. The belt-drive system for coupling the cutting roll 64 to the third miter gearbox 62 is shown best in FIG. 10. The gearboxes 56 and 62 are supported by support brackets 68 and 70, respectively, which are affixed to the right side cutting frame 20. The miter gearbox 46 is supported by a bracket 66, which is affixed to the right side feed/print frame 24.

Figure 3:
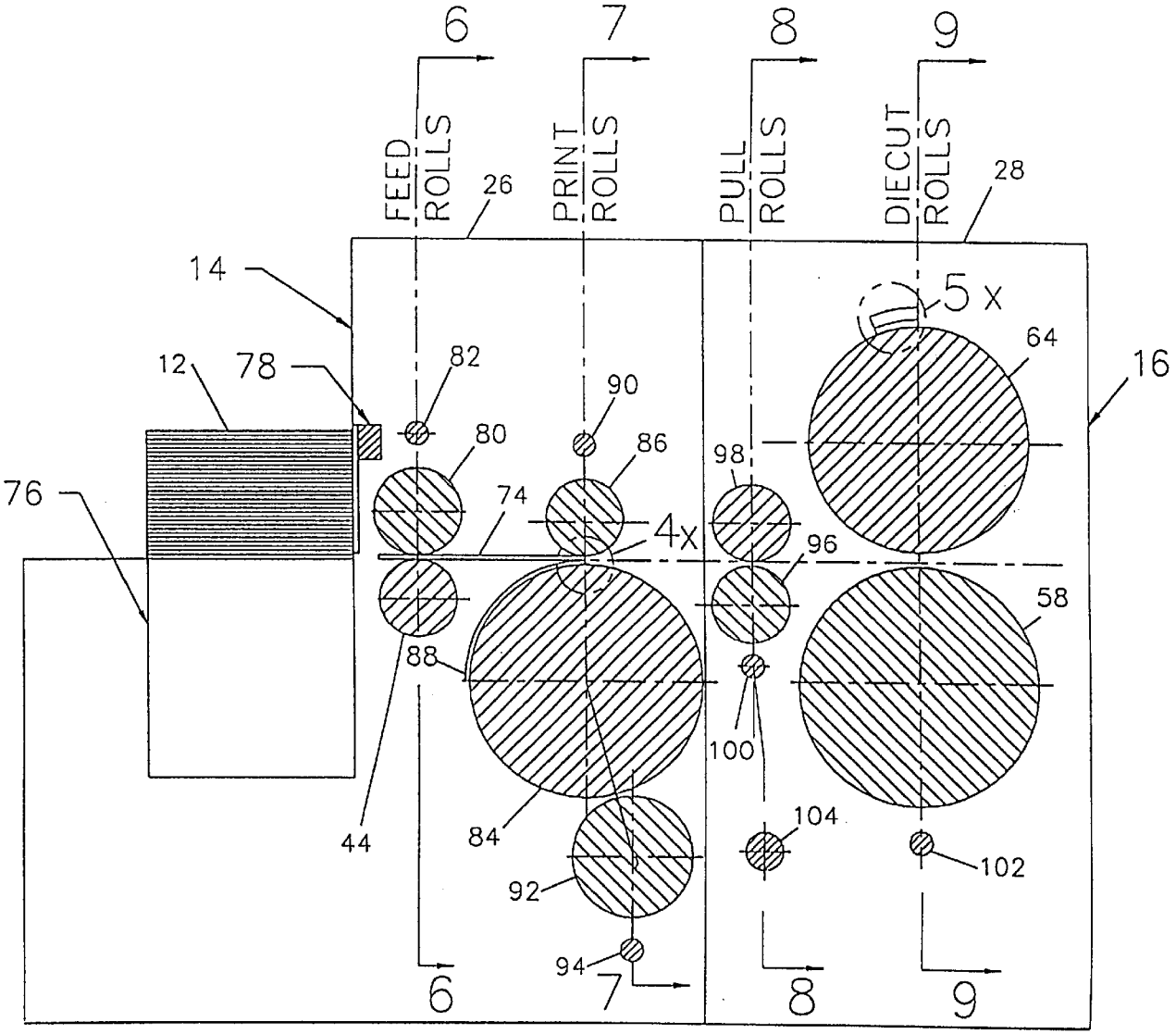
FIG. 3 is a longitudinal section view through the center of the printer-cutter machine.

FIG. 3 is a longitudinal section view through the center of the printer-cutter machine 10. A feed mechanism 76 feeds the corrugated paperboard blanks, represented by the blank 74, from the bottom of the stack 12 through the machine in the machine direction. A feed gate assembly 78 is supported between the right and left feed/print frames 24 and 26. The gate assembly 78 guides the blank 74 from the feed mechanism 76 into the feed roll nip between the lower feed roll 44 and an upper feed roll 80 of the feed/print machine section 14. An caliper adjust shaft 82 adjusts the position of the upper feed roll 80 to adjust the feed roll nip to accommodate blanks of varying thickness, as shown best in FIGS. 6 and 10.

Figure 6:
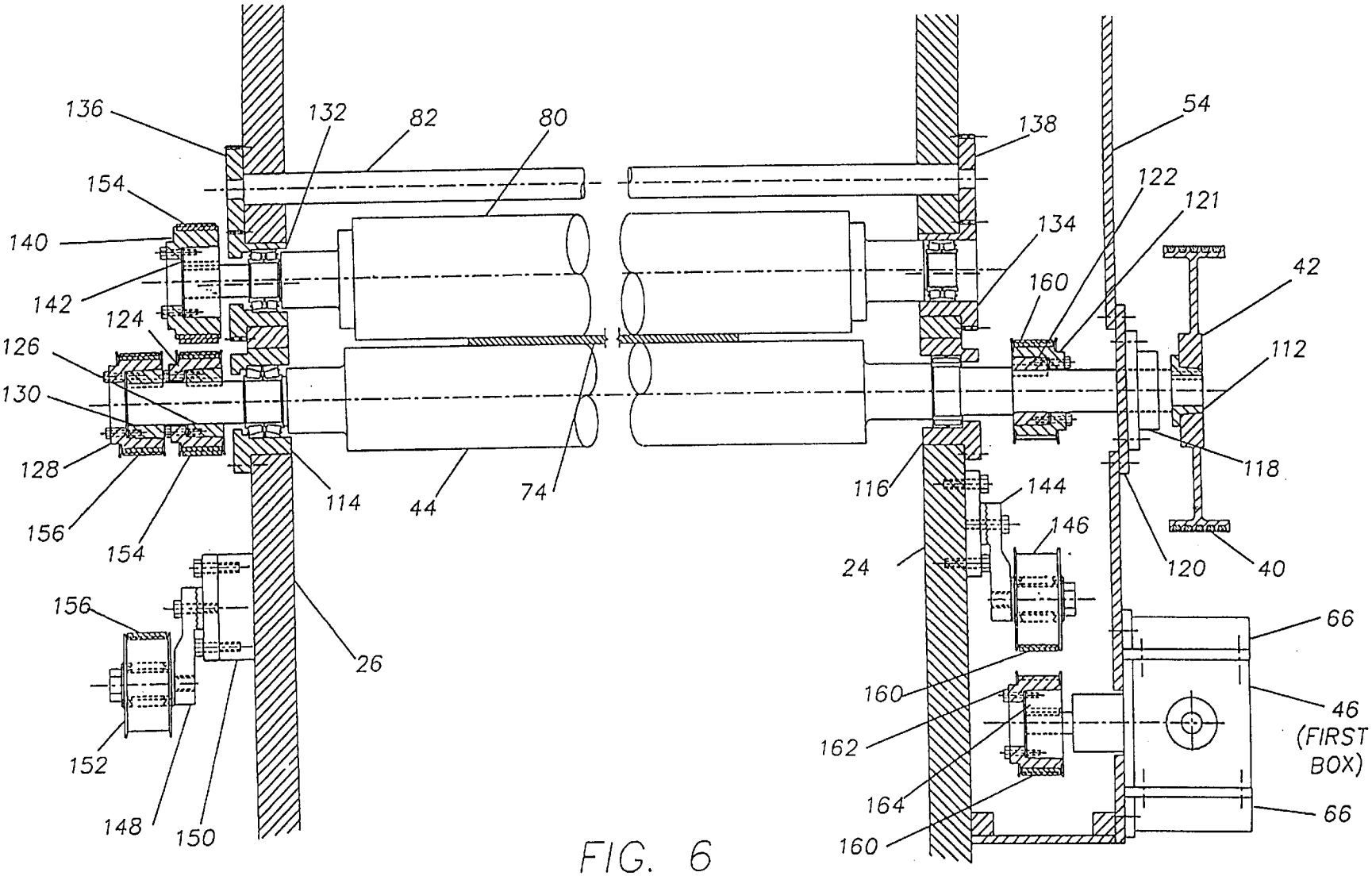
FIG. 6 is a cross sectional view of the feed rolls of the printer-cutter machine taken along line 6—6 of FIG. 3.

The feed roll 44 drives the first miter gearbox 46, as shown best in FIG. 6, to provide power for the cutter machine section 16. The feed rolls 44 and 80 pass the blank 74 to the print roll nip between a lower print roll 84 and an upper impression roll 86. The print roll 84 carries a printing plate 88 that prints an image on the blank 74. A caliper adjust shaft 90 adjusts the position of the upper impression roll 86 to adjust the print roll nip to accommodate blanks of varying thickness. A flexographic roll 92 positioned under the lower print roll 84 applies ink to the printing plate 88 as the printing plate rolls past the flexographic roll. A caliper adjust shaft 94 adjusts the position of the flexographic roll 92 to adjust the flexographic roll nip to accommodate printing plates of varying thickness, as shown best in FIG. 7.

The print rolls 84 and 86 pass the blank 74 to the pull roll nip between a lower pull roll 96 and an upper pull roll 98 of the cutting machine section 16. The caliper adjust shaft 100 adjusts the position of the lower pull roll 96 to adjust the pull roll nip to accommodate blanks of varying thickness, as shown best in FIG. 8. The pull rolls 96 and 98 pass the blank 74 to the nip between the lower anvil roll 58 and the upper cutting roll 64 of the cutting machine section 16. The caliper adjust shaft 102 adjusts the position of the cutting roll 64 to adjust the cutting roll nip to accommodate blanks of varying thickness, as shown best in FIG. 9. The lower pull roll 96 and the lower anvil roll 58 are driven by a torque shaft 104, which is driven by the second miter gearbox 56, as shown best in FIGS. 8 and 11. The upper pull roll 98 and the upper cutting roll 64 are driven by the third miter gearbox 62, as shown best in FIG. 10.

Printing And Cutting Registration

Figure 4:
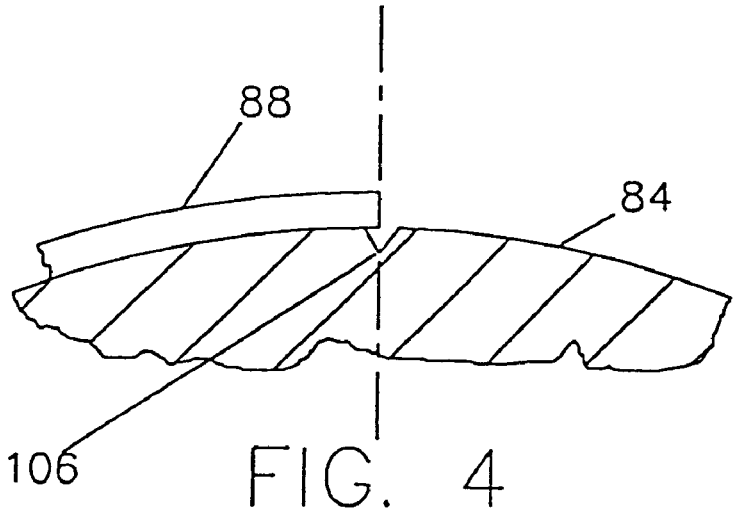
FIG. 4 is an enlarged detail view of the zero timing mark on the print roll of the printer-cutter machine at 4*x* of FIG. 3.

FIG. 4 is an enlarged detail view of the area labeled as 4*x* in FIG. 4, which shows the zero timing mark on the print roll 84 of the printer-cutter machine 10. The printing plate 88 is affixed to the print roll 84 in alignment with a timing mark 106 scribed longitudinally on the surface of the print roll. The operation of the feed mechanism 76 is synchronized with the rotation of the print roll 84 so that the timing mark 106 coincides with the leading edge of the printing plate 88 and the leading edge of the blank 74 as the blank passes through the feed/print machine section 14.

Figure 5:
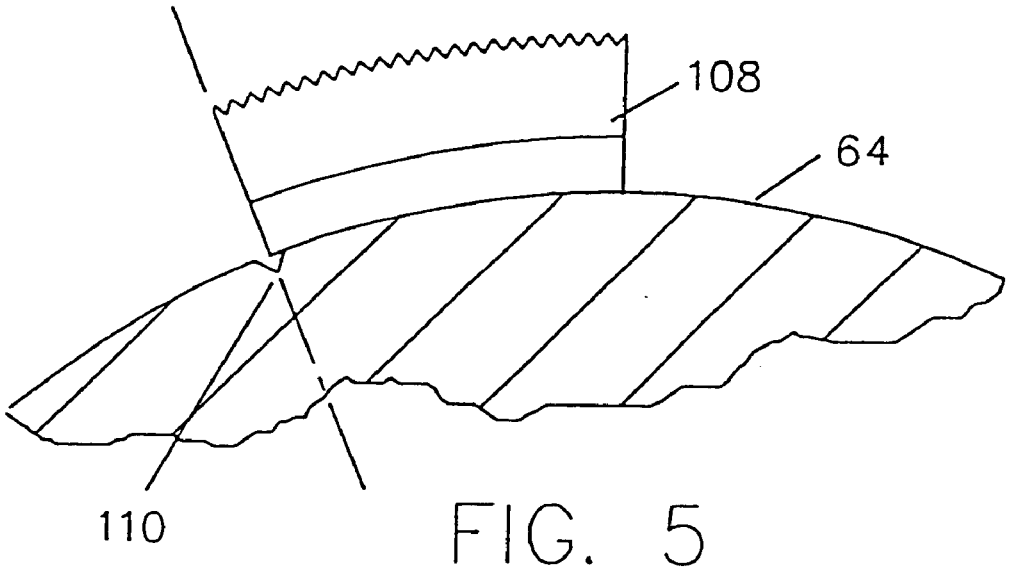
FIG. 5 is an enlarged detail view of the zero timing mark on the cutting roll of the printer-cutter machine at 5*x* of FIG. 3.

FIG. 5 is an enlarged detail view of the area labeled as 5*x* in FIG. 4, which shows the zero timing mark on the cutting roll 64 of the printer-cutter machine 10. A cutting die 108 or a suitable cutting blade is affixed to the cutting roll 64 in alignment with a timing mark 110 scribed longitudinally on the surface of cutting roll. The operation of the feed mechanism 76 is synchronized with the rotation of the cutting roll 64 so that the timing mark 110 coincides with the leading edge of the cutting die 108 and the leading edge of the blank 74 as the blank passes through the cutting machine section 16. The timing marks 106 and 110 are described in greater detail below with reference to FIGS. 6–8.

Feed/Print Machine Section—Feed Rolls

FIG. 6 is a cross sectional view of the feed rolls 44 and 80 of the printer-cutter machine 10 taken along line 6—6 of FIG. 3. The main drive motor 34 (see FIG. 1) drives the V-belt 40, which drives the V-belt driven sheave 42, which is fixed to a the lower feed roll 44 by a tapered bushing 112. The lower feed roll 44 is rotatably supported in the left side feed/print frame 26 by a first concentric bearing housing 114, and in the right side feed/print frame 26 by a second concentric bearing housing 116. The concentric bearing housings 114 and 116 are fixedly mounted in the left and right side feed/print frames 26 and 24, respectively.

The lower feed roll 44 is also rotatably supported on the right side of the machine by an outboard flange bearing 118. The outboard flange bearing 118 is bolted to an access plate 120. The access plate 120 is supported by the guard 54, which is supported by the right side feed/print frame 24. A synchronous belt sprocket 121 is fixed to lower feed roll 44 by a tapered bushing 122 outboard of the right side feed/print frame 24. As used herein, a "synchronous belt sprocket" means a toothed sprocket designed for rotating, non-slipping engagement with a toothed belt, which is referred to herein as a "synchronous belt." Synchronous belts and sprockets are sometimes referred to in the art as a "timing belts" and "timing gears." Another synchronous belt sprocket 124 is fixed to the lower feed roll 44 by a tapered bushing 126 outboard of the left side feed/print frame 26. Yet another synchronous belt sprocket 128 is fixed to the lower feed roll 44 by a tapered bushing 130, outboard of the synchronous belt sprocket 124. The synchronous belt sprockets 121, 124, and 128 are horizontally aligned on the lower feed roll 44 to form a coupled-set of synchronous belt sprockets.

The upper feed roll 80 is rotatably supported by an eccentric bearing housing 132 in the left side feed/print frame 26 and by an eccentric bearing housing 134 in the right side feed/print frame 24. The eccentric bearing housings 132 and 134 are rotatably supported by the left and right feed/print frames 26 and 24, respectively. The outer diameters of the eccentric bearing housings 132 and 134 are eccentric with respect to the centerline of the upper feed roll 80. The caliper adjust shaft 82 is rotatably supported by the feed/print frames 24 and 26 above the upper feed roll 80.

Each of a pair of spur-type gears 136 and 138 is keyed to an opposing end of the caliper adjust shaft 82. The spur-type gears 136 and 138 mesh with gear teeth of the eccentric bearing housings 132 and 134, respectively, which extend radially outward along the outer diameters of the eccentric bearing housings. Thus, the caliper adjust shaft 82 may be rotated to adjust the vertical position of the upper feed roll 80 with respect to the feed/print frames 24 and 26 to adjust the feed roll nip. A synchronous belt sprocket 140 is fixed to the upper feed roll 80 by a tapered bushing 142 outboard of the left side feed/print frame 26. The synchronous belt sprocket 140 is mounted in vertical alignment with the synchronous belt sprocket 124.

An adjustable take-up assembly 144 is supported by the feed/print frame 24 on the right side of the machine 10. The adjustable take-up assembly 144 may be a commercially-available belt drive tensioner, such as a Model 7720-1020A take-up assembly manufactured by Gates Rubber Company of Denver Colo. A flat-faced idler roller 146 is rotatably supported by the adjustable take-up assembly 144. Unlike synchronous belt sprockets, flat-faced idler rollers, such as the flat-faced idler roller 146, are usually deployed in engagement with the non-toothed side of a synchronous belt. The flat-faced idler roller 146 is mounted in the same vertical plane as the synchronous belt sprocket 121.

An adjustable take-up assembly 148 is supported by a spacer block 150 on the left side of the feed/print machine section 14. The adjustable take-up assembly 148 may also be a commercially-available belt drive tensioner, such as a Model 7720-1020A take-up assembly manufactured by Gates Rubber Company of Denver Colo. The spacer block 150 is supported by the left side feed/print frame 26. A flat-faced idler roller 152 is rotatably supported by the adjustable take-up assembly 148. The flat-faced idler roller 152 is mounted in the sane vertical plane as the synchronous belt sprocket 128. A synchronous belt 154, which is a "dual" synchronous belt in that it has teeth on both sides, is in contact with the synchronous belt sprockets 124 and 140, as shown best in FIG. 11. The synchronous belt 154, which drives the adjustable rollers of the feed/print machine section 14, will be referred to as the "dual auto-tensioned feed/print section belt 154."

Figure 11:
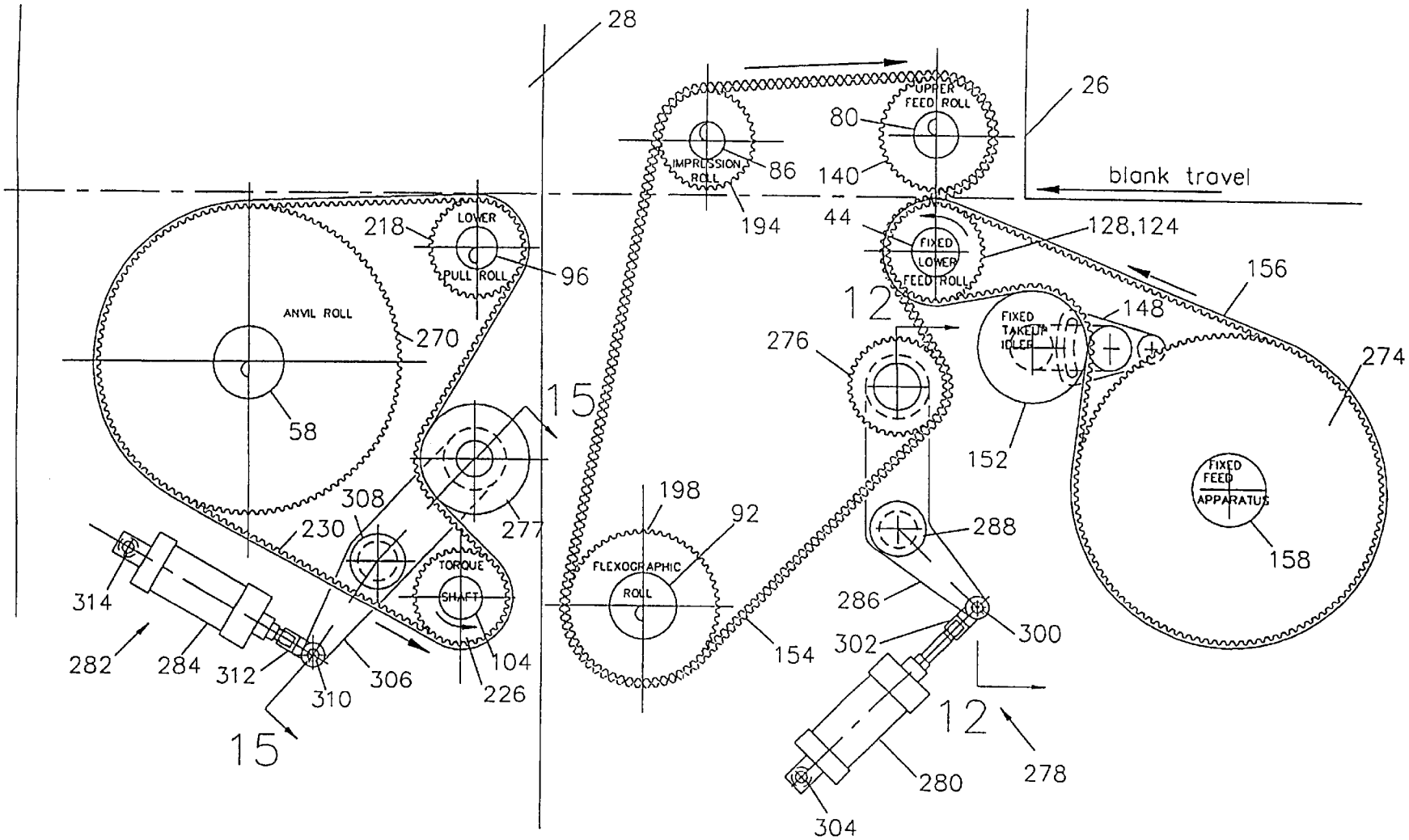
FIG. 11 is a side elevation showing the synchronous drive belts on the left side of the printer-cutter machine.
Figure 14:
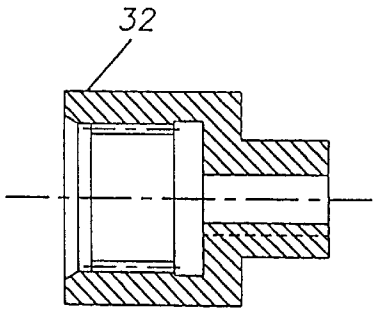
FIG. 14 is a cross section showing the external half of the spline-type coupling between the machine sections of the printer-cutter machine.
Figure 13:
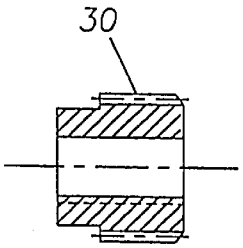
FIG. 13 is an enlarged cross section showing the internal half of the spline-type coupling between the machine sections of the printer-cutter machine.

A synchronous belt 156 is in contact with the synchronous belt sprocket 128 and the flat-faced idler roller 152, also shown best in FIG. 11. The synchronous belt 156 drives a feed mechanism input shaft 158 and will be referred to as the "feed-mechanism belt 156."

The first miter gearbox 46 is supported by upper and lower support brackets, commonly denoted by 66, on the right side of the feed/print machine section 14. The first miter gearbox 46 is mounted on the guard 54, which serves as a housing positioned outboard of a synchronous belt 160. The synchronous belt 160, which drives the fixed rolls of the feed/print section 14, will be referred to as the "fixed feed/print section belt 160." The V-belt driven sheave 42 and the first miter gearbox 46 are both mounted outboard of the guard 54.

A synchronous belt sprocket 162 is fixed to the input shaft of the first miter gearbox 46 by a tapered bushing 164. The synchronous belt sprocket 162 is mounted in vertical alignment with the synchronous belt sprocket 121, in the same vertical plane as the idler roller 146, and in horizontal alignment with the first miter gearbox 46. The fixed feed/print section belt 160 is in contact with the synchronous belt sprocket 121, the synchronous belt sprocket 162, and the idler roller 146, as shown best in FIG. 10.

Feed/Print Machine Section—Print Rolls

Figure 7:
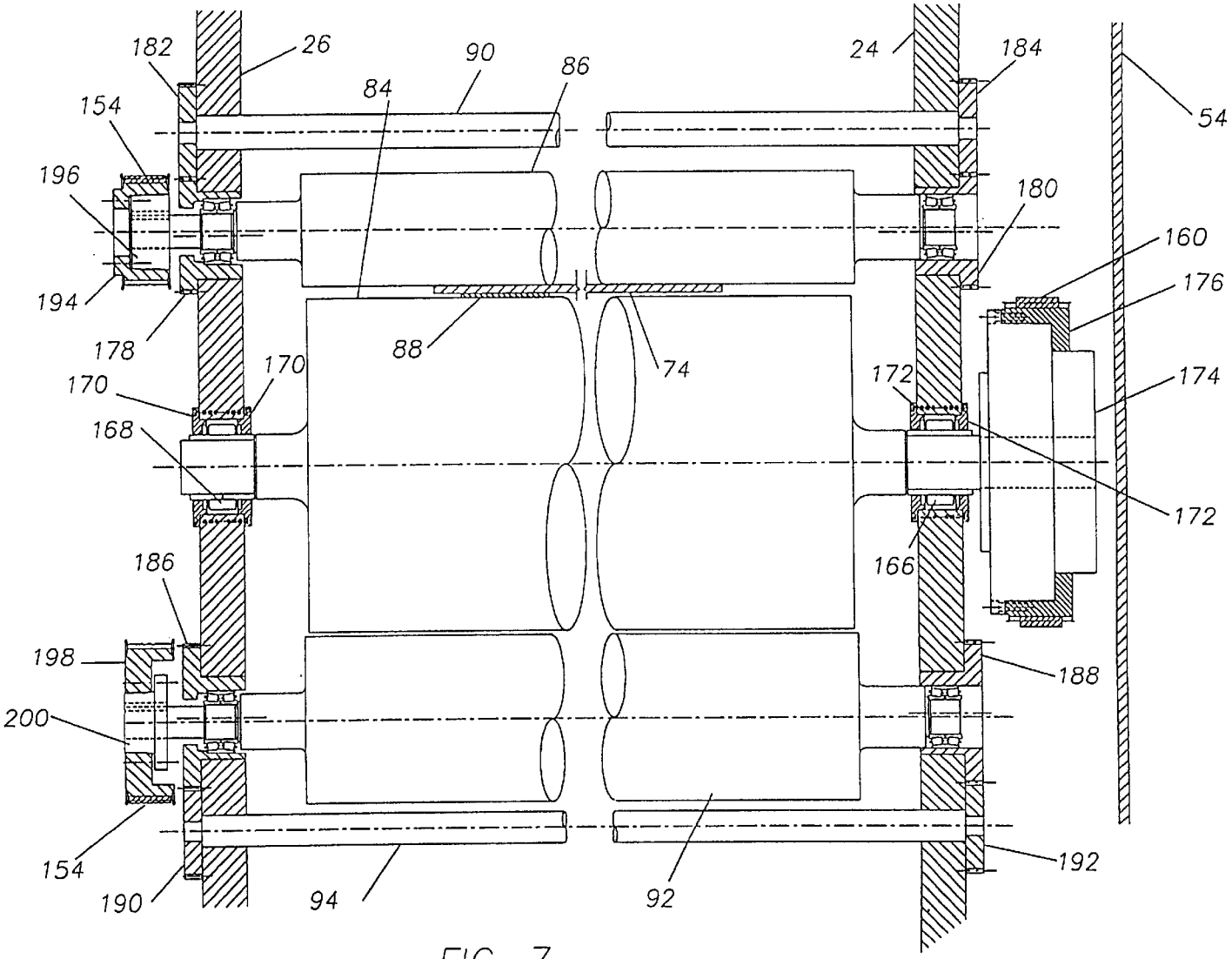
FIG. 7 is a cross sectional view of the print roll, impression roll, and flexographic engraved roll of the printer-cutter machine taken along line 7—7 of FIG. 3.

FIG. 7 is a cross sectional view of the lower print roll 84, the upper impression roll 86, and the engraved flexographic ink-applying roll 92 of the printer-cutter machine 10 taken along line 7—7 of FIG. 3. The lower print roll 84 is rotatably supported in the right side feed/print frame 24 by a bearing 166, and in the left side feed/print frame 26 by a bearing 168. The bearings 166 and 168 are retained in the right and left side feed/print frame 24 and 26 by retainers 170 and 172, respectively. A printing register assembly 174 is keyed to the lower print roll 84 outboard of the right side feed/print frame 24. A synchronous belt sprocket 176, referred to as the "printing register sprocket 176," is fixed to the printing register assembly 174. The fixed feed/print section belt 160 is engaged with the printing register sprocket 176, as shown best in FIG. 10.

The upper impression roll 86 is rotatably supported by an eccentric bearing housing 178 in the left side feed/print frame 26, and by an eccentric bearing housing 180 in the right side feed/print frame 24. The eccentric bearing housings 178 and 180 are rotatably supported by left and right feed/print frames 26 and 24, respectively. The outer diameters of the eccentric bearing housings 178 and 180 are eccentric with respect to the centerline of the upper impression roll 86.

The caliper adjust shaft 90 is rotatably supported by the left and right feed/print frames 26 and 24 above impression roll 86. Each of a pair of spur-type gears 182 and 184 is keyed to an opposing end of the caliper adjust shaft 90. The spur-type gears 182 and 184 mesh with gear teeth of the eccentric bearing housings 178 and 180, respectively, which extend radially outward along the outer diameters of the eccentric bearing housings. Thus, the caliper adjust shaft 90 may be rotated to adjust the vertical position of the upper impression roll 86 with respect to the feed/print frames 24 and 26 to adjust the print roll nip.

The flexographic roll 92 is rotatably supported by an eccentric bearing housing 186 in the left side feed/print frame 26, and by an eccentric bearing housing 188 in the right side feed/print frame 24. The eccentric bearing housings 186 and 188 are rotatably supported by the left and right feed/print frames 26 and 24, respectively. The outer diameters of the eccentric bearing housings 186 and 188 are eccentric with respect to the centerline of he flexographic roll 92.

The caliper adjust shaft 94 is rotatably supported by the right and left feed/print frames 24 and 26 below the flexographic roll 92. Each of a pair of spur-type gears 190 and 192 is keyed to an opposing end of the caliper adjust shaft 94. The spur-type gears 190 and 192 mesh with gear teeth of the eccentric bearing housings 186 and 188, respectively, which extend radially outward along the outer diameters of the eccentric bearing housings. Thus, the caliper adjust shaft 94 may be rotated to adjust the vertical position of the flexographic roll 92 with respect to the feed/print frames 24 and 26 to adjust the flexographic roll nip.

A synchronous belt sprocket 194 is fixed to the impression roll 86 by a tapered bushing 196 outboard of the left side feed/print frame 26 and in vertical alignment with a synchronous belt sprocket 198, which is fixed to the flexographic roll 92. The synchronous belt sprocket 198 is fixed to the flexographic roll 92 by a tapered bushing 200 outboard of the left side feed/print frame 26 and in the same vertical plane as the synchronous belt sprocket 194. The synchronous belt 94 engages the synchronous belt sprockets 194 and 198, as shown best in FIG. 11.

Cutter Machine Section—Pull Rolls

Figure 8:
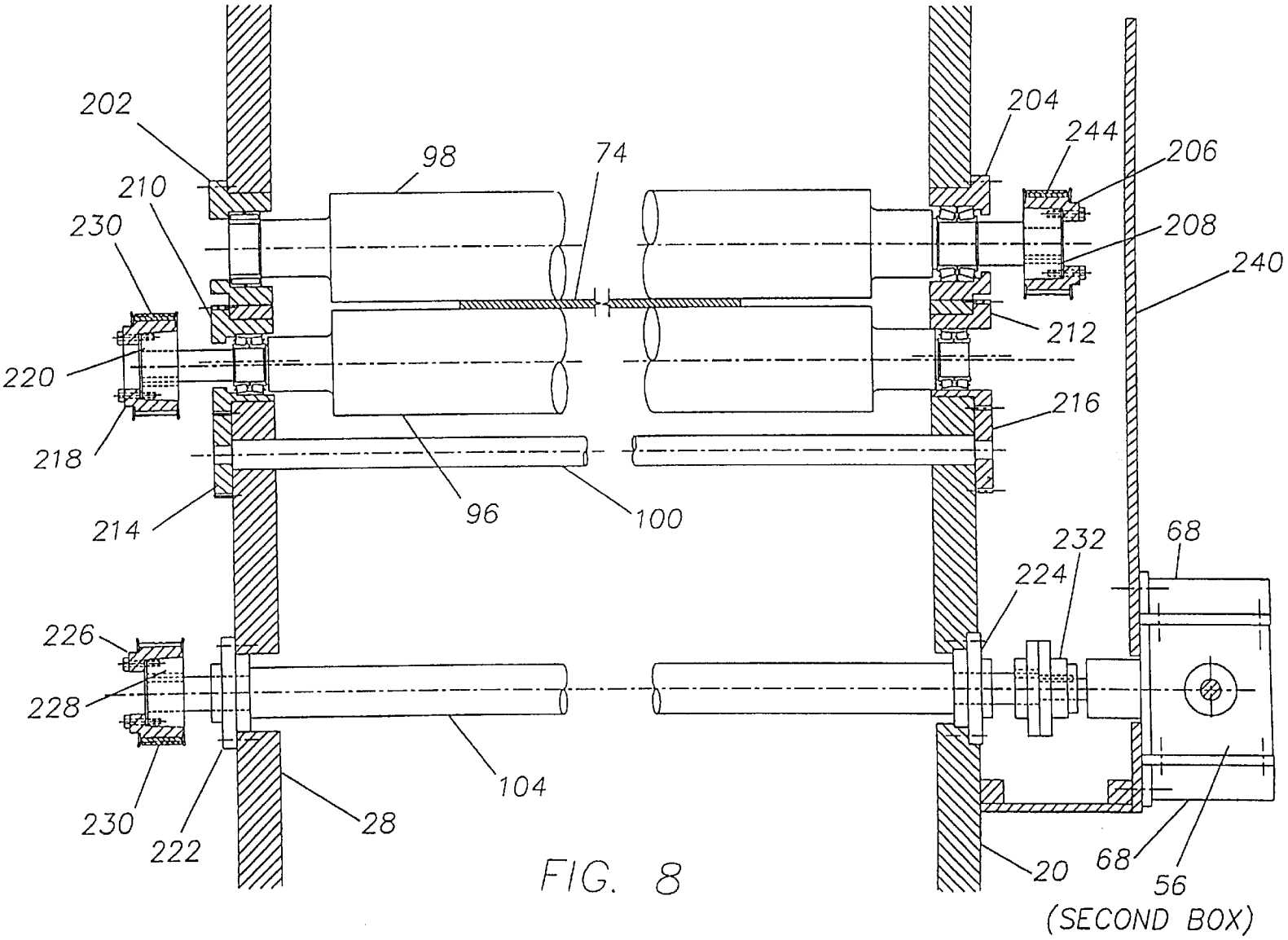
FIG. 8 is a cross sectional view of the pull rolls of the printer-cutter machine taken along line 8—8 of FIG. 3.

FIG. 8 is a cross sectional view of the upper pull roll 98 and the lower pull roll 96 of the printer-cutter machine 10 taken along line 8—8 of FIG. 3. The upper pull roll 98 is rotatably supported in the left side cutter frame 28 by a concentric bearing housing 202, and in the right side cutter frame 20 by a concentric bearing housing 204. The concentric bearing housings 202 and 204 are fixedly mounted in the left and right cutter frames 28 and 20, respectively. A synchronous belt sprocket 206 is fixed to upper pull roll 98 by a tapered bushing 208 outboard of the right side cutter frame 20.

The lower pull roll 96 is rotatably supported by an eccentric bearing housing 210 in the left side cutter frame 28 and by an eccentric bearing housing 212 in the right side cutter frame 20. The eccentric bearing housings 210 and 212 are rotatably supported by the left and right cutter frames 28 and 20, respectively. The outer diameters of the eccentric bearing housings 210 and 212 are eccentric with respect to the centerline of the lower pull roll 96.

The caliper adjust shaft 100 is rotatably supported by the left and right cutter frames 28 and 20 below the lower pull roll 96. Each of a pair of spur-type gears 214 and 216 is keyed to an opposing end of the caliper adjust shaft 100. The spur-type gears 214 and 216 mesh with gear teeth of the eccentric bearing housings 210 and 212, respectively, which extend radially outward along the outer diameters of the eccentric bearing housings. Thus, the caliper adjust shaft 100 may be rotated to adjust the vertical position of the lower pull roll 96 to adjust the pull roll nip.

A synchronous belt sprocket 218 is fixed to the lower pull roll 96 by a tapered bushing 220 outboard of the left side cutter frame 28. The torque shaft 104 is rotatably mounted in the left and right side cutter frames 28 and 20 by a pair of flange bearings, 222 and 224, respectively. A synchronous belt sprocket 226 is fixed to the left side of the torque shaft 104 by a tapered bushing 228 outboard of the left side cutter frame 28. The synchronous belt sprocket 226 is mounted in vertical alignment with the synchronous belt sprocket 218. A synchronous belt 230 is engaged with the sprockets 218 and 226, as shown best in FIG. 11. The synchronous belt 230, which drives the automatically tensioned rollers of the cutting machine section 16, is referred to as the "auto-tensioned cutting section belt 230."

A rigid coupling 232 couples the right end of the torque shaft 104 to an output shaft of the second miter gearbox 56. The second miter gearbox 56 is supported by upper and lower support brackets, commonly denoted by 68, on the right side of the cutter machine section 16. The support brackets 68 are supported by a guard 240 that serves as a housing positioned outboard of the synchronous belt sprocket 206 and the rigid coupling 232 (the guard 240 is also shown in FIG. 1.) The guard 240 is supported by the right side cutter frame 20 so that the second miter gearbox 56 is aligned horizontally with the torque shaft 104 and the rigid coupling 232. A synchronous belt 244 engages the sprocket 206, as shown best in FIG. 10. The synchronous belt 244, which drives the fixed rolls of the cutting section 16, will be referred to as the "fixed cutting section belt 244."

Cutter Machine Section—Cutting Rolls

Figure 9:
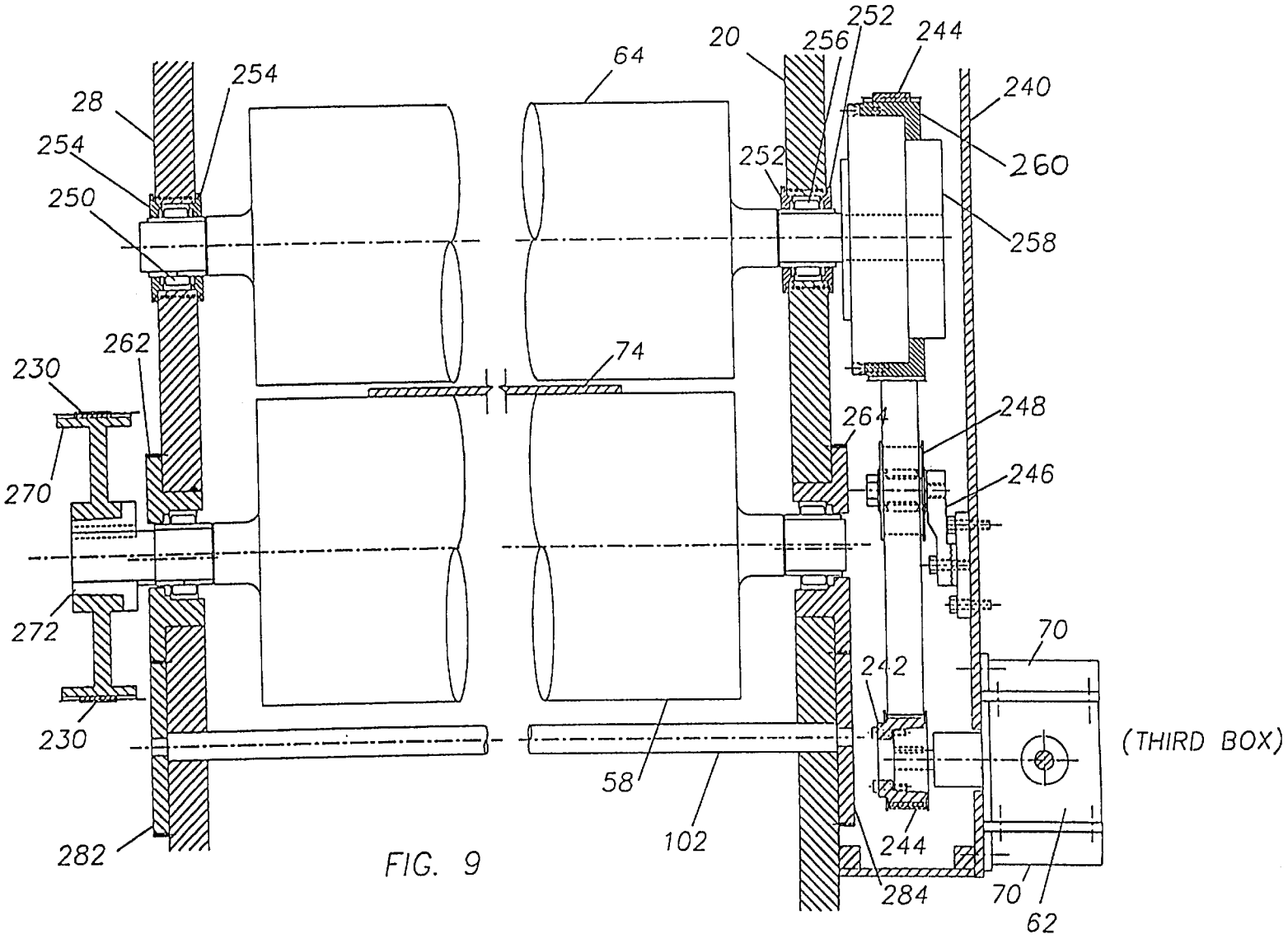
FIG. 9 is a cross sectional view of the cutting roll and anvil roll of the printer-cutter machine taken along line 9—9 of FIG. 3.

FIG. 9 is a cross sectional view of the upper cutting roll 64 and the lower anvil roll 58 of the printer-cutter machine 10 taken along line 9—9 of FIG. 3. The third miter gearbox 62 is supported by upper and lower support brackets, commonly denoted by 70, on the right side of the cutter machine section 16. The support brackets 70 are supported by the guard 240. A synchronous belt sprocket 242 is fixed to an output shaft of the third miter gearbox 62. An adjustable take-up assembly 246 is also supported the guard 240. A flat-faced idler roller 248 is rotatably supported by the adjustable take-up assembly 246. The adjustable take-up assembly 246 may be a commercially-available belt drive tensioner, such a as Model 7720-1020 manufactured by Gates Rubber Company of Denver Colo. The flat-faced idle roller 248 is mounted in the same vertical plane as the synchronous belt sprocket 242.

The upper cutting roll 64 is rotatably supported in the left side cutter frame 20 by a bearing 250 and in the right side cutter frame 28 by a bearing 252. The bearing 250 is retained in the left side cutter frame 20 by a retainer 254 and the bearing 252 is retained in the right side cutter frame 28 by a retainer 256. A cutting register assembly 258 is keyed to the upper cutting roll 64 outboard of the right side cutter frame 20. A synchronous belt sprocket 260, which is referred to as the "cutting register sprocket 260," is fixed to the cutting register assembly 258 in the same vertical plane as the synchronous belt sprocket 242. The fixed cutting section belt 244 engages the synchronous belt sprockets 242 and 260, and the idler roller 248, as shown best in FIG. 10.

The lower anvil roll 58 is rotatably supported by an eccentric bearing housing 262 in the left side cutter frame 28 and by an eccentric bearing housing 264 in the right side cutter frame 20. The eccentric bearing housings 262 and 264 are rotatably supported by the left and right cutter frames 28 and 20, respectively. The outer diameters of the eccentric bearing housings 262 and 264 are eccentric with respect to the centerline of the anvil roll 58. The caliper adjust shaft 102 is rotatably supported by the right and left cutter frames 20 and 28 below the anvil roll 58. Each of a pair of spur-type gears 266 and 268 is keyed to an opposing end of the caliper adjust shaft 102. The spur-type gears 266 and 268 mesh with gear teeth of the eccentric bearing housings 262 and 264, respectively, which extend radially outward along the outer diameters of the eccentric bearing housings. Thus, the caliper adjust shaft 102 may be rotated to adjust the vertical position of the anvil roll 58 with respect to the cutter frames 14 and 28 to adjust the print roll nip.

A synchronous belt sprocket 270 is fixed to the anvil roll 58 by a tapered bushing 272 outboard of the left side cutter frame 28. The auto-tensioned cutting section belt 230 is in engagement with synchronous belt sprocket 270, as shown best in FIG. 11.

Fixed Belts On Right Side Of Machine

Figure 10:
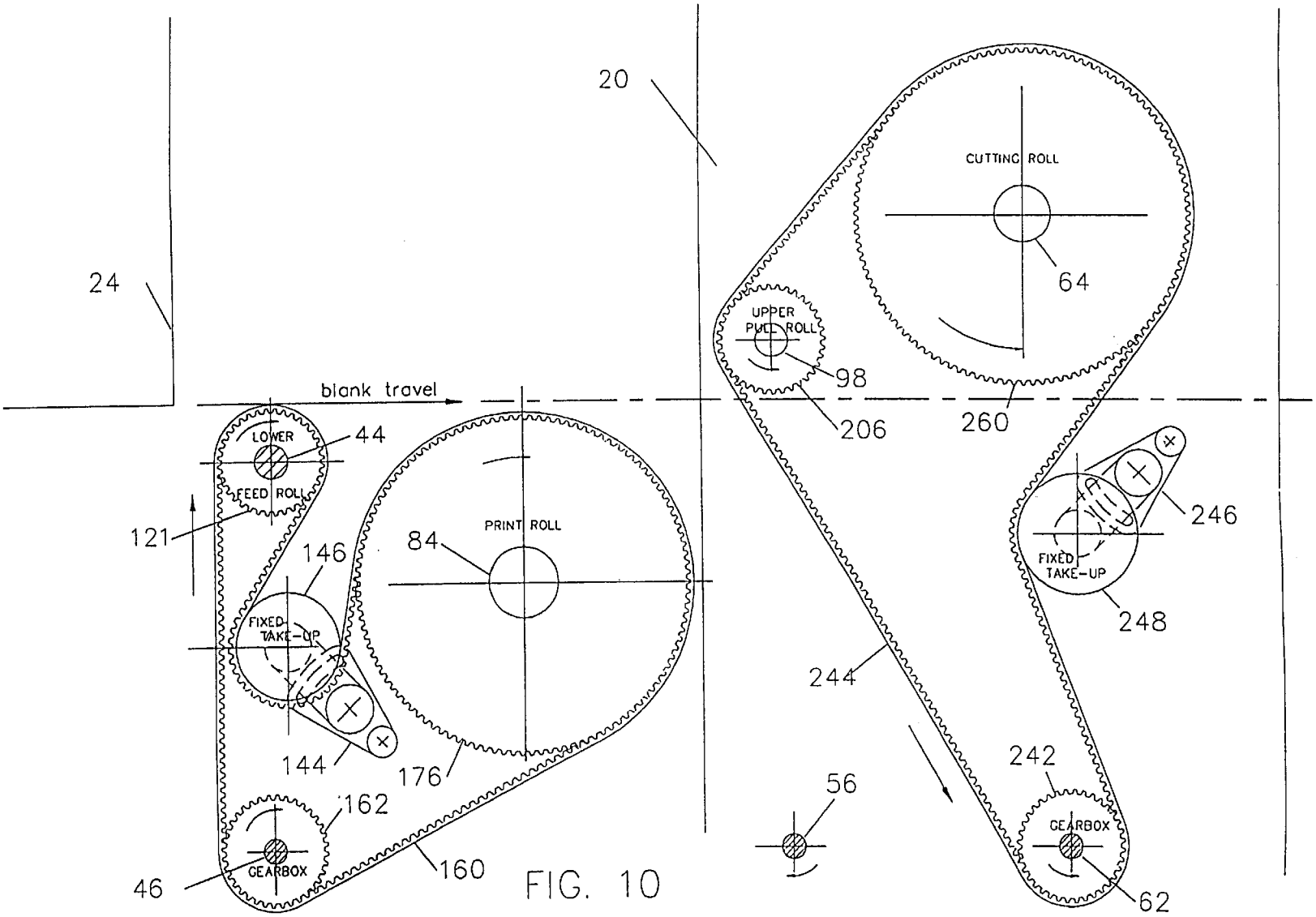
FIG. 10 is a side elevation showing the synchronous drive belts on the right side of the printer-cutter machine.

FIG. 10 is a side elevation showing the fixed feed/print section belt 160 and the fixed cutting section belt 244 on the right side of the printer-cutter machine 10. Referring to the right side of the feed/print machine section 14, the fixed feed/print section belt 160 couples the rotational motion of the printing register sprocket 176 (which drives the lower print roll 84), the sprocket 162 (which drives the first miter gear box 46), the sprocket 121 (which is driven by the lower feed roll 44), and the idler roller 146 (which is part of the take-up assembly 144). The take-up assembly 144 is manually adjusted to maintain proper tension in the fixed feed/print section belt 160 when the belt is initially installed. The fixed feed/print section belt 160, which typically need not be adjusted again for the life of the belt, functions as a fixed-center idler belt during operation of the printer-cutter machine 10.

Referring to the right side of the cutting machine section 16, the fixed cutting section belt 244 couples the rotational motion of the cutting register sprocket 260 (which drives the upper cutting roll 64), the sprocket 206 (which drives the upper pull roll 98), the sprocket 242 (which is driven by the third miter gear box 62), and the idler roller 248 (which is part of the take-up assembly 246). The take-up assembly 246 is manually adjusted to maintain proper tension in the fixed cutting section belt 244 when the belt is initially installed. The fixed cutting section belt 244, which typically need not be adjusted again for the life of the belt, functions as a fixed-center idler belt during operation of the printer-cutter machine 10.

Fixed Belt On Left Side Of Machine

FIG. 11 is a side elevation showing the synchronous drive belts 154, 156, and 226 on the left side of the printer-cutter machine 10. Referring to the left side of the feed/print machine section 14, a synchronous belt sprocket 274 drives the feed mechanism input shaft 158. The feed mechanism input shaft 158 drives the feed mechanism 76 (see FIG. 3). The feed mechanism 76 is supported between the left and right feed/print frames 26 and 24. The feed mechanism 76 is preferably bolted to the side frames 24 and 26. The feed-mechanism belt 156 couples the rotational motion of the sprocket 274 (which drives the feed mechanism input shaft 158), the drive sprocket 128 (which is driven by the lower feed roll 44), and the idler roller 152 (which is part of the take-up assembly 148). The take-up assembly 148 is manually adjusted to maintain proper tension in the feed-mechanism belt 156 when the belt is initially installed. The fixed feed-mechanism belt 156, which typically need not be adjusted again for the life of the belt, functions as a fixed-center idler belt during operation of the printer-cutter machine 10.

Auto-Tensioned Belts On Left Side Of Machine

The dual auto-tensioned feed/print section belt 154 couples the rotational motion of the sprocket 198 (which drives to the flexographic roll 92), the sprocket 194 (which drives the upper impression roll 86), the sprocket 140 (which drives the upper feed roll 80), the drive sprocket 124 (which is driven by the lower feed roll 44), and a toothed idler roller 276 (which is part of an automatic take-up 278 for the dual auto-tensioned feed/print section belt 154). An actuator, such as an air cylinder 280, automatically adjusts the position of the toothed idler roller 276 to maintain proper tension in the dual auto-tensioned feed/print section belt 154, as described below.

Referring to the left side of the cutter machine section 16, the auto-tensioned cutting section belt 230 couples the rotational motion of the sprocket 270 (which drives the lower anvil roll 58), the sprocket 218 (which drives the lower pull roll 96), a flat-faced idler roller 277 (which is part of an automatic take-up 282 for the auto-tensioned cutting section belt 230), and the sprocket 226 (which is driven by the torque shaft 104, which, in turn, is driven by the second miter gearbox 56). An air cylinder 284 automatically adjusts the position of the flat-faced idler roller 277 to maintain proper tension in the auto-tensioned cutting section belt 230, as described below.

Automatic Take-Ups

Figure 12:
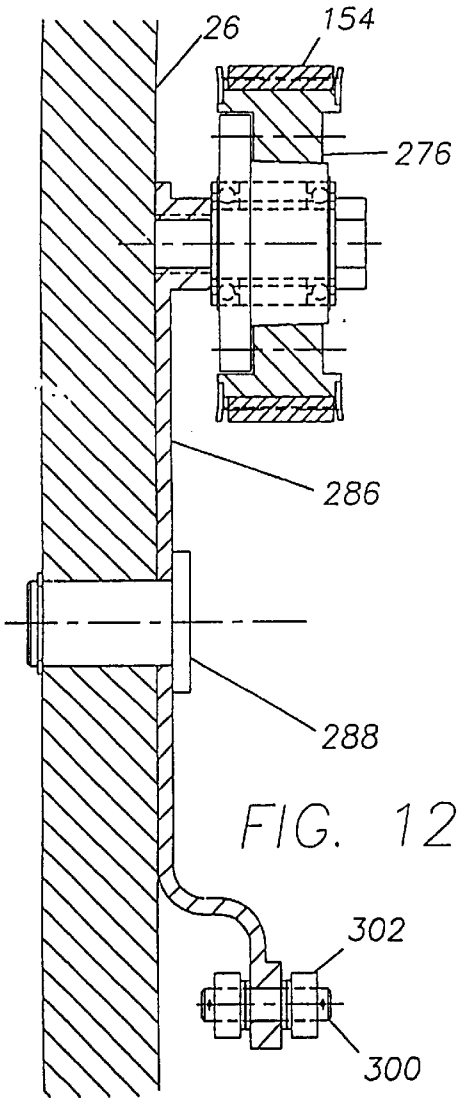
FIG. 12 is an enlarged section through an automatic belt take-up taken along line 12—12 of FIG. 11.

FIG. 12 is an enlarged section through the automatic take-up 278 for the dual auto-tensioned feed/print section belt 154 taken along line 12—12 of FIG. 11. Referring now to FIGS. 11 and 12, a pivot arm 286 is pivotably supported by a pin 288. The pivot pin 288 is supported by the left side feed/print frame 26. The toothed idler sprocket 276 is rotatably supported by the pivot arm 286 on one side of the pivot pin 288. A pin 300 is rotatably supported by the pivot arm 286 on the opposite side of the pivot pin 288. A clevis 302 is rotatably supported by the pivot pin 288. One end of the air cylinder 280 is threaded into the clevis 302. The opposite end of the air cylinder 280 is rotatably supported by a pin 304. The pin 304 is supported by the frame 26. Thus, the tension of the dual auto-tensioned feed/print section belt 154 may be adjusted by adjusting the air pressure within the air cylinder 280 to adjust the pressure of the toothed idler roller 276 against the belt 154.

Figure 15:
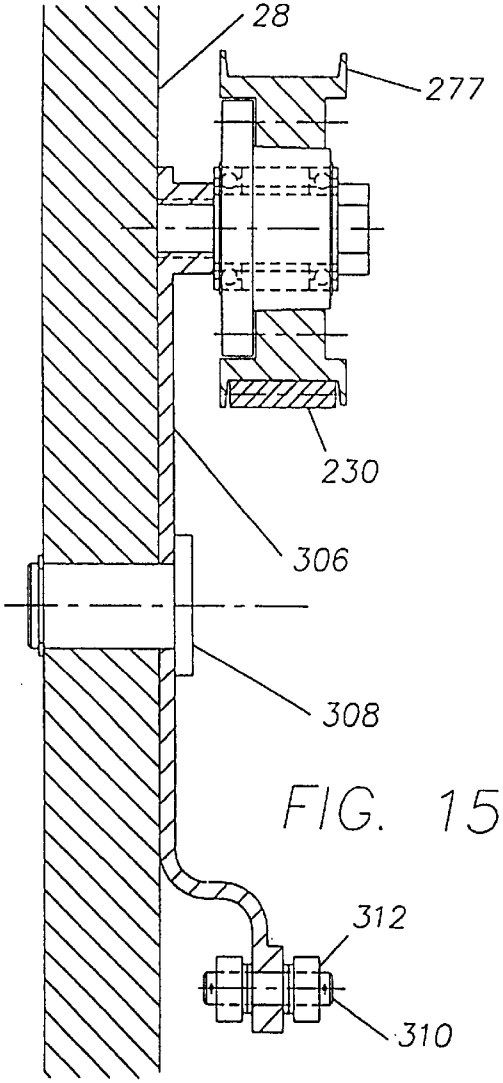
FIG. 15 is an enlarged section through the automatic belt take-up taken along line 15—15 of FIG. 11.

FIG. 15 is an enlarged section through the automatic take-up 282 for the auto-tensioned cutting section belt 230 taken along line 15—15 of FIG. 11. Referring now to FIGS. 11 and 15, a pivot arm 306 is pivotably supported by a pin 308. The pivot pin 308 is supported by left side cutter frame 28. The flat-faced idler roller 277 is rotatably supported by the pivot arm 306 on one side of the pivot pin 308. A pin 310 is rotatably supported by the pivot arm 306 on the opposite side of the pivot pin 308. A clevis 312 is rotatably supported by the pivot pin 308. One end of the air cylinder 284 is threaded into the clevis 312. The opposite end of the air cylinder 284 is rotatably supported by a pin 314. The pin 314 is supported by the left side cutter frame 28. Thus, the tension of the auto-tensioned cutting section belt 230 may be adjusted by adjusting the air pressure within the air cylinder 284 to adjust the pressure of the flat-faced idler roller 277 against the belt 230.

Figure 16:
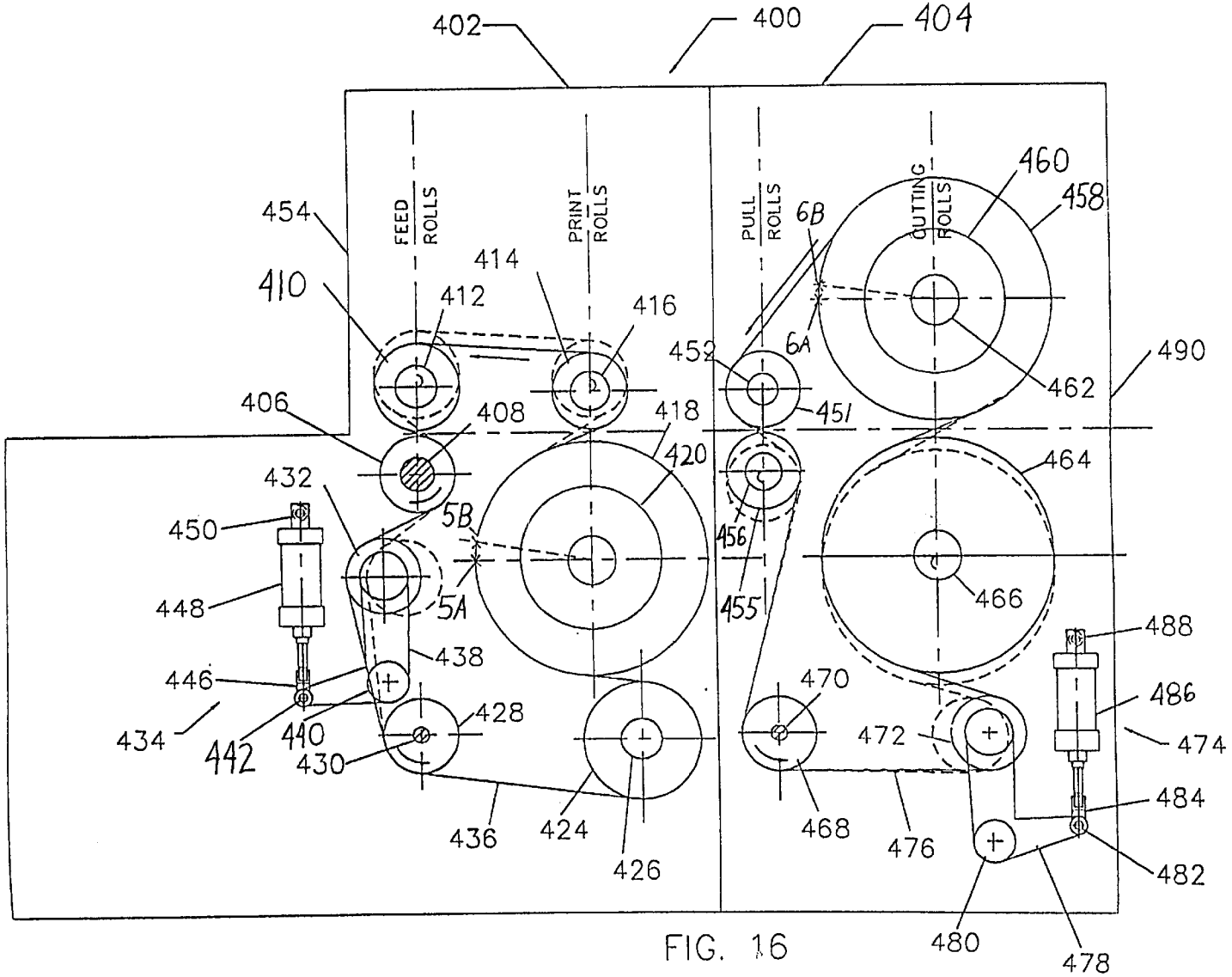
FIG. 16 is a right side elevation of the printer-cutter machine showing an alternative synchronous belt drive arrangement.

Structure Of An Alternative Printer-Cutter Machine With Fixed And Adjustable Rolls Driven By The Same Belt FIG. 16 is a right side elevation view of a printer-cutter machine 400 showing an alternative synchronous belt drive arrangement. The right side elevation shown in FIG. 16 corresponds to the longitudinal section view shown in FIG. 3. The alternative synchronous belt drive arrangement is illustrated schematically in FIG. 16. The belts and sprockets are shown as single solid lines in the illustration. Similar to the printer-cutter machine 10, the machine 400 includes movable print/feed section 402 that is separable from a fixed cutting section 404 using a spline-type separable coupling and a separation facilitator, which are not shown in FIG. 16.

A synchronous belt sprocket 406 is supported by a fixed lower feed roll 408. A synchronous belt sprocket 410 is supported by an adjustable upper feed roll 412. A synchronous belt sprocket 414 is supported by an adjustable upper impression roll 416. A synchronous belt sprocket 418 is supported by a printing register assembly 420. The printing register assembly 420 is supported by a lower print roll 422. A synchronous belt sprocket 424 is supported by a flexographic roll 426. Another synchronous belt sprocket 428 is supported by a first miter gearbox 430.

Yet another synchronous belt sprocket 432 is part of an automatic take-up 434 for a dual synchronous belt 436. The synchronous belt sprocket 432 is rotatably supported by a pivot arm 438 on one side of a pivot pin 440. A pin 442 is rotatably supported by the pivot arm 438 on the opposite side of the pivot pin 440. A clevis 446 is rotatably supported by the pivot pin 442. One end of an air cylinder 448 is threaded into the clevis 446. The opposite end of the air cylinder 448 is rotatably supported by a pin 450. The pin 450 is supported by the right side feed/print frame 454.

The dual synchronous belt 436 is in engagement with the synchronous belt sprockets 406, 410, 414, 418, 424, 428, and 432. The tension of the dual synchronous belt 436 may be manually adjusted by adjusting air pressure within the air cylinder 448 to adjust the pressure of the synchronous belt sprocket 432 against the belt 436.

A synchronous belt sprocket 451 is supported by a fixed upper pull roll 452. Another synchronous belt sprocket 455 is supported by the adjustable lower pull roll 456. Another synchronous belt sprocket 458 is supported by a cutting register assembly 460, which is supported by the fixed cutting roll 462. Yet another synchronous belt sprocket 464 is supported by a lower adjustable anvil roll 466.

A synchronous belt sprocket 468 is supported by a second miter gearbox 470. Another synchronous belt sprocket 472 is part of an automatic take-up 474 for a dual synchronous belt 476. The synchronous belt sprocket 472 is rotatably supported by a pivot arm 478 on one side of a pivot pin 480. A pin 482 is rotatably supported by the pivot arm 478 on an opposite side of the pivot pin 480. A clevis 484 is rotatably supported by the pivot pin 482. One end of an air cylinder 486 is threaded into the clevis 484. The opposite end of the air cylinder 486 is rotatably supported by a pin 488. The pin 488 is supported by the right side cutter frame 490.

The dual synchronous belt 476 is in engagement with the synchronous belt sprockets 451, 455, 458, 464, 468 and 472. The tension of the dual synchronous belt 476 may be manually adjusted by adjusting the air pressure within the air cylinder 486 to adjust the pressure of the synchronous belt sprocket 472 against the belt 476.

Operation Of The Printer-Cutter Machine With Fixed And Adjustable Rolls Driven By Separate Belts Referring to FIG. 3, paperboard blanks, represented by the blank 74, are individually fed from the bottom of the stack 12 by the feed mechanism 76 so that one blank is fed for each rotation of the print roll 84 and the cutting roll 64. The operation of a suitable feed mechanism is described in Sardella, U.S. Pat. No. 4,614,335. The feed mechanism 76 accelerates the blank 74 to the surface speed of the machine 10 and transports the leading edge of the blank to the nip between adjustable upper feed roll 80 and fixed lower feed roll 44.

The blank 74 is next transported to the nip between lower fixed print roll 84 and the upper adjustable impression roll 86. The leading edge of the blank 74 is shown in FIG. 3 at the moment it has reached the vertical centerline of the print roll 84. The leading edge of the blank 74 is shown precisely aligned with the leading edge of the printing plate 88 mounted on the print roll 84.

Referring to FIG. 4, the leading edge of printing plate 88 is mounted on the print roll 84 in alignment with the zero timing mark 106 and the vertical centerline of the print roll 84. The timing mark 106 has been previously inscribed longitudinally along the surface of the print roll 84. The synchronized cyclic relationship of the feed mechanism 76 and the print roll 84 is such that the leading edge of each blank processed by machine 10 coincides with the leading edge of the printing plate 88 and the zero timing mark 106.

The blank 74 is next transported to the nip between upper fixed pull roll 98 and the lower adjustable pull roll 96. The rotating nip between upper fixed pull roll 98 and the lower adjustable pull roll 96 transports the blank 74 to the nip between the adjustable lower anvil roll 58 and the fixed upper cutting roll 64.

Referring to FIG. 5, the leading edge of the cutting die 108 is mounted on cutting roll 64 in alignment with the zero timing mark 110. The timing mark 110 has been previously inscribed longitudinally along the surface of the cutting roll 64. The synchronized cyclic relationship of the feed mechanism 76 and the cutting roll 64 is such that the leading edge of the blank 74 processed by the machine 10, the leading edge of the cutting die 108, and the zero timing mark 110 coincide in alignment with the vertical centerline of the fixed cutting roll 64.

The thickness or caliper of the blank 74 can typically vary in practice from approximately 1/16 inch to 3/8 inch (0.16 to 0.95 cm). Accordingly, a method for adjusting the opening of the roll nips is provided. As noted above, each roll nip includes one fixed roll and one adjustable roll. In the embodiment shown, each adjustable roll is supported by a pair of eccentric bearing housings. Those skilled in the art will appreciate that the amount of the adjustment provided by the eccentric bearing housings could be varied to increase or decrease the caliper adjustment range of the corresponding nip.

Referring to FIG. 6, rotating the caliper adjust shaft 82 causes the spur-type gears 136 and 138 to rotate the eccentric bearing housings 132 and 134, respectively, and depending on the direction of rotation, either increase or decrease the gap at the nip between the adjustable upper feed roll 80 and the fixed lower feed roll 44. The various caliper adjust shafts are usually adjusted using a manual ratchet wrench, as is well known to those skilled in the art.

Referring to FIG. 7, rotating the caliper adjust shaft 90 causes the spur-type gears 182 and 184 to rotate the eccentric bearing housings 178 and 180, respectively, and depending on the direction of rotation, either increase or decrease the gap at the nip between the adjustable upper impression roll 86 and the fixed lower print roll 84. Similarly, rotating the caliper adjust shaft 94 causes the spur-type gears 190 and 192 to rotate the eccentric bearing housings 186 and 188, respectively, and depending on the direction of rotation, either increase or decrease the gap at the nip between the adjustable flexographic roll 92 and the fixed print roll 84. The flexographic roll 92 transfers ink to the printing plate 88 for each revolution of the print roll 84. The gap between the print roll 84 and the flexographic roll 92 is adjustable for the proper inking of the printing plate 88.

Referring to FIG. 8, rotating the caliper adjust shaft 100 causes the spur-type gears 214 and 216 to rotate the eccentric bearing housings 202 and 204, respectively, and depending on the direction of rotation, either increase or decrease the gap at the nip between adjustable lower pull roll 96 and the fixed upper pull roll 98. And referring to FIG. 9, rotating the caliper adjust shaft 102 causes the spur-type gears 282–284 to rotate the eccentric bearing housings 262–264 and, depending on the direction of rotation, either increase or decrease the gap at the nip between the adjustable lower anvil roll 58 and the upper fixed cutting roll 64.

Referring now to the several drawings simultaneously, the main drive motor 34 rotates the V-belt drive sheave 38, causing the V-belt 40 to rotate the V-belt driven sheave 42 (FIG. 1). The V-belt driven sheave 42 drives the fixed lower feed roll 44 to transfer drive power to the feed/print machine section 14 (FIG. 6). The machine described thus far generally is substantially similar to a conventional machine for printing and cutting paperboard blanks.

The fixed lower feed roll 44 drives the synchronous belt sprockets 121, 124, and 128 (FIG. 6). The synchronous belt sprocket 128 drives the feed-mechanism belt 156, which drives the synchronous belt sprocket 274 and the feed mechanism input shaft 158 (FIG. 11). The feed mechanism 76 feeds one blank for each revolution of the synchronous belt sprocket 274, which corresponds to one revolution of the feed mechanism input shaft 158. The adjustable take-up assembly 148 is initially adjusted to position the flat-faced idler roller 152 so as to properly tension the feed-mechanism belt 156 (FIG. 11). Thereafter, the idler roller 152 rotates freely on a fixed center.

The synchronous belt sprocket 121 drives the fixed feed/print section belt 160 (FIG. 10). The fixed feed/print section belt 160 drives the printing register sprocket 176, which drives the lower print roll 84 (FIG. 7). The lower print roll 84 rotates one revolution for each blank fed by the feed mechanism 76. The fixed feed/print section belt 160 also rotates the synchronous belt sprocket 162, which drives the input shaft of the first miter gearbox 46 (FIG. 8). The take-up assembly 144 is initially adjusted to position flat-faced idler roller 146 so as to properly tension the fixed feed/print section belt 160 (FIG. 10). Thereafter, the idler roller 146 rotates freely on a fixed center.

The output shaft of the first miter gearbox 46 drives the rigid coupling 48, the stub shaft 50, the internal spline-typed coupling half 30, the external spline-typed coupling half 32, the input shaft of the second miter gearbox 56, the rigid coupling 60, and the input shaft of the third miter gearbox 62 (FIG. 1). This linkage transfers power from the feed/print machine section 14 to the cutting machine section 16.

In the cutting machine section 16, the synchronous belt sprocket 242 mounted on the output shaft of the third miter gearbox 62 rotates the fixed cutting section belt 244 (FIG. 9). The fixed cutting section belt 244 drives the synchronous belt sprocket 206, which drives the upper pull roll 98 (FIG. 8). The fixed cutting section belt 244 also drives the cutting register sprocket 260, which drives the upper cutting roll 64 (FIG. 9). The upper cutting roll 64 rotates one revolution for each blank fed by the feed mechanism 76. The take-up assembly 246 is initially adjusted to position flat-faced idler roller 248 so as to properly tension of the fixed cutting section belt 244 (FIG. 10). Thereafter, the idler roller 248 rotates freely on a fixed center.

The synchronous belt sprocket 274 driving the feed mechanism input shaft 158 (FIG. 11), the printing register sprocket 176 driving the lower print roll 84 (FIG. 10), and the cutting register sprocket 260 driving the upper cutting roll 64 (FIG. 10), all have the same number of teeth and make one revolution per blank fed through the printer-machine 10. The synchronous belt sprocket 128 (FIG. 11), the synchronous belt sprocket 121 (FIG. 10), the synchronous belt sprocket 162 (FIG. 10), the synchronous belt sprocket 242 (FIG. 11), and the synchronous belt sprocket 226 (FIG. 11) all have an equal number of teeth so that they all rotate at the same rate.

The first miter gearbox 46, the second miter gearbox 56, and the third miter gearbox 62 have a one-to-one gear ratio (FIG. 10). The synchronous belt sprockets 121, 124, and 128 form a coupled-set of synchronous belt sprockets for synchronously coupling the driven sheave 42 (FIG. 6) to the fixed feed/print section belt 160, the dual auto-tensioned feed/print section belt 154, and to the feed-mechanism belt 156 (FIG. 11), to synchronously drive the feed mechanism input shaft 158 and the rolls of the feed/print machine section 14. That is, the synchronous belt sprocket 121 drives the fixed feed/print section belt 160, the synchronous belt sprocket 128 drives the feed-mechanism belt 156, and the synchronous belt sprocket 124 drives the dual synchronous belt 154, which drives the adjustable rolls 80, 86, and 92 of the feed/print machine section 14. The synchronous belt sprocket 274 driving the feed mechanism input shaft 158, the printing register sprocket 176 driving the print roll 84, and the cutting register sprocket 260 driving the cutting roll 64, therefore rotate in synchronism (FIGS. 10 and 11).

The printing register sprocket 176 driving the lower print roll 84 is mounted on the printing register assembly 174 (FIG. 7). The printing register assembly 174 transmits the rotation of the printing register sprocket 176 in a one-to-one ratio to the lower print roll 84. The printing register assembly 174 is used to alter the relative radial position of the printing register sprocket 176 and the lower print roll 84 so that the position of the printed image can be located in a desired position relative to the leading edge of the blank 74. For example, the printed image may be located precisely five inches (12.7 cm), within the machine tolerance, or another desired distance from the leading edge of the blank 74. The details of the construction of the printing register assembly 174 are not shown, being well known to those skilled in the art. As described below, the printing register assembly 174, once set, need not be adjusted in response to changes in the thickness of the blank 74 to cause the printed image to be located in the desired position.

The cutting register sprocket 260 driving the upper cutting roll 64 is mounted on the cutting register assembly 258 (FIG. 9). The cutting register assembly 258 transmits the rotation of the cutting register sprocket 260 in a one-to-one ratio to the upper cutting roll 64. The cutting register assembly 258 is used to alter the relative radial position of the cutting register sprocket 260 and the upper cutting roll 64, so that the position of the die cut shape, such as a window or a hand hold, can be located at a desired position on the blank 74 relative to the leading edge of the blank 74. For example, the die cut may be located precisely six inches (15.2 cm), within the machine tolerance, or another desired distance from the leading edge of the blank 74. The details of the construction of the cutting register assembly 258 are not shown, being well known to those skilled in the art. As described below, the cutting register assembly 258, once set, need not be adjusted in response to changes in the thickness of the blank 74 to cause the die cut shape to be located in the desired position.

The apparatus thus far described includes a feed mechanism 76, a lower print roll 84, and an upper cutting roll 64 that operate in a synchronized cyclic relationship driven by a synchronous belt drive. The main drive motor 34 and V-belt 40 assembly is located outboard of the right feed/print frames machine 10 and drives the machine 10 by way of the driven sheave 42, which is located on the end of the lower feed roll 44 outboard of the right side feed/print frame guard 54. The drive motor 34 thereby drives the input shaft 158 of the feed mechanism 76, the lower print roll 84, and the upper cutting roll 64 in synchronism. The machine 10 is calibrated so that the leading edge of the printing plate 88 and the leading edge of the cutting die 108 initially contact the blank 74 at the leading edge of the blank 74.

The dual auto-tensioned feed/print section belt 154, with teeth on both sides of the belt, is driven by the synchronous the belt sprocket 124 (FIG. 2), which is driven by the lower feed roll 44, which is driven by the sheave 42 (FIG. 6). The dual auto-tensioned feed/print section belt 154 drives the synchronous belt sprocket 140, which drives the adjustable upper feed roll 80 (FIG. 6). The dual auto-tensioned feed/print section belt 154 also drives the synchronous belt sprocket 194, which drives the adjustable impression roll 86 (FIG. 7). The dual auto-tensioned feed/print section belt 154 also drives the synchronous belt sprocket 198, which drives the adjustable flexographic roll 92 (FIG. 7). The dual auto-tensioned feed/print section belt 154 also contacts the synchronous belt idler sprocket 276, which is part of the automatic take-up 278 for the dual auto-tensioned feed/print section belt 154 (FIG. 11).

Referring to FIG. 11, the synchronous belt idler sprocket 276 is located on the slack side of the dual auto-tensioned feed/print section belt 154. The pivot arm 286 pivots about the pivot pin 288. The air cylinder 280 is pivotably supported by the pin 304 on one end and by the clevis 302 on its opposite end. The clevis 302 is rotatably attached to the pivot arm 286 by the pin 300. The air cylinder 280 is attached to the pivot arm 286 opposite the idler sprocket 276 relative to the pivot pin 288. The impression roll 86 and the upper feed roll 80 are shown adjusted downward to their lowest limit, and the flexographic roll 92 is shown adjusted upward to its upper limit. The air cylinder 280 is partially extended and a predetermined amount of air pressure is applied on the cylinder so as to pull the pivot arm 286, thereby causing the idler sprocket 276 to maintain tension in the dual auto-tensioned feed/print section belt 154.

It will be appreciated that if the upper impression roll 86, and/or the upper feed roll 80 are adjusted upward, and/or the flexographic roll 92 is adjusted downward, the idler sprocket 276 automatically pivots in a counter-clockwise direction and pushes the shaft of the air cylinder 280 inward against the air pressure in the cylinder, maintaining tension in the dual auto-tensioned feed/print section belt 154. The air cylinder 280, and the air pressure within the air cylinder, are selected to maintain the tension in the dual auto-tensioned feed/print section belt 154 within an acceptable range throughout the adjustment range of the idler sprocket 276, without having to alter the air pressure within the air cylinder. Thus, adjustment of the adjustable impression roll 86, and/or the upper feed roll 80, and/or the flexographic roll 92, in response to changes in the thickness of the blanks does not affect the position of the printing or cutting relative to the leading edges of the blanks. Furthermore, the position of the adjustable impression roll 86, and/or the upper feed roll 80, and/or the flexographic roll 92 may be adjusted while maintaining constant machine speed and without affecting the proper registration between the machine sections and the leading edge of the paperboard blank.

The auto-tensioned cutting section belt 230 is driven by the synchronous belt sprocket 226, which is driven by the torque shaft 104, which is driven by the output shaft of the second miter gearbox 56 (FIG. 8). The auto-tensioned cutting section belt 230 drives the synchronous belt sprocket 270, which drives the adjustable lower anvil roll 58 (FIG. 9). The auto-tensioned cutting section belt 230 also drives the synchronous belt sprocket 218, which drives the adjustable lower pull roll 96 (FIG. 8). The auto-tensioned cutting section belt 230 also contacts the flat-faced take-un idler roller 277, which is part of the adjustable take-up 282 for the auto-tensioned cutting section belt 230 (FIG. 11).

Referring to FIG. 11, the flat take-up idler roller 277 is located on the slack non-toothed side of the auto-tensioned cutting section belt 230. The pivot arm 306 pivots about the pivot pin 308. The air cylinder 284 is pivotably supported by the pin 314 on one end and by the clevis 312 on its opposite end. The clevis 312 is rotatably attached to the pivot arm 306 by the pin 310. The air cylinder 284 is attached to the pivot arm 306 opposite the flat-faced take-up idler roller 277 relative to the pivot pin 308. The lower anvil roll 58 and the lower pull roll 96 are shown adjusted upward to their upper limits. The air cylinder 284 is partially extended and a predetermined amount of air pressure is applied on the cylinder so as to push the pivot arm 306, thereby causing the idler roller 277 to maintain tension in the auto-tensioned cutting section belt 230.

It will be appreciated that if the lower anvil roll 58, and/or the lower pull roll 96 are adjusted downward, the take-up idler roller 277, which is pushed by the shaft of the air cylinder 284 moving outward against the air pressure in the cylinder, automatically pivots in a counter-clockwise direction to automatically maintain tension in the auto-tensioned cutting section belt 230. The air cylinder 314 may then be operated to automatically return the tension in the auto-tensioned cutting section belt 230 to the desired level. The air cylinder 314, and the air pressure within the air cylinder, are selected to maintain the tension in the auto-tensioned cutting section belt 230 within an acceptable range throughout the adjustment range of the idler roller 277, without having to alter the air pressure within the air cylinder. Thus, adjustment of the adjustable anvil roll 58, and/or lower pull roll 96, in response to changes in the thickness of the blanks does not affect the position of the printing or cutting relative to the leading edges of the blanks. Furthermore, the position of the adjustable anvil roll 58 and/or lower pull roll 96 may be adjusted while maintaining constant machine speed and without affecting the proper registration between the machine sections and the leading edge of the paperboard blank.

The arrangement described above, in which the fixed rolls and the adjustable rolls in each machine section 14 and 16 are driven by separate synchronous belts, is the most desirable configuration for a printer-cutter machine requiring highly accurate placement of the printed images and cut shapes when the blanks to be processed have significant variations in thickness.

Operation Of The Alternative Printer-Cutter Machine With Fixed And Adjustable Rolls Driven By The Same Belt FIG. 16 shows an alternate arrangement of a dual synchronous drive apparatus for the machine 400. In this arrangement, only one dual synchronous belt 436 is used to drive the fixed and adjustable rolls in a feed/print machine section 402. Similarly, only one dual synchronous belt 476 is used to drive the fixed and adjustable rolls in a cutting machine section 404. That is, in both machine sections, a single synchronous belt drives both the fixed and adjustable rolls. The impression roll 416 and the upper feed roll 412 are shown adjusted downward to their lower limits, and the flexographic roll 426 is shown adjusted upward to its upper limit, by the solid lines in the schematic drawing of FIG. 16. The impression roll 416 and the upper feed roll 412 are shown adjusted upward to their upper limits, and flexographic roll 426 is shown adjusted downward to its lower limit, by the broken lines in the schematic drawing of FIG. 16.

In the feed/print machine section 402, the lower fixed feed roll 408 drives the synchronous belt sprocket 406. The synchronous belt sprocket 406 drives the dual synchronous belt 436. The dual synchronous belt 436 drives the synchronous belt sprocket 410, which drives the adjustable upper feed roll 412. The dual synchronous belt 436 also drives the synchronous belt sprocket 414, which drives the adjustable impression roll 416. The dual synchronous belt 436 also drives the synchronous belt sprocket 420, which drives the fixed print roll 422. The dual synchronous belt 436 also drives the synchronous belt sprocket 424, which drives the adjustable flexographic roll 426. The dual synchronous belt 436 also drives the synchronous belt sprocket 428, which drives the fixed input shaft of a first miter gearbox 430. The dual synchronous belt 436 also contacts the synchronous belt idler sprocket 432, which is part of an automatic take-up 434 for the dual synchronous belt 436.

The synchronous belt idler sprocket 432 is rotatably supported by the pivot arm 438. The synchronous belt idler sprocket 432 is located on the slack side of the dual synchronous belt 436. The pivot arm 438 pivots about pivot pin 440. The air cylinder 448 is pivotably supported by the pin 450 on one end and by the clevis 446 on its opposite end. The clevis 446 is rotatably attached to the pivot arm 438 by the pin 442. The air cylinder 448 is attached to the pivot arm 438 opposite the idler sprocket 432 relative to the pivot pin 440. The impression roll 416 and the upper feed roll 416 are shown adjusted downward to their lower limits, and the flexographic roll 426 is shown adjusted upward to its upper limit, by the solid lines in the schematic drawing of FIG. 16. The air cylinder 448 is partially extended and a predetermined amount of air pressure is applied on the cylinder so as to the push the pivot arm 438, thereby causing the idler sprocket 432 to maintain tension in the dual synchronous belt 436.

It will be appreciated that, as indicated by the broken lines in FIG. 16, if the impression roll 416, and/or the upper feed roll 412, are adjusted upward, idler sprocket 432 automatically pivots in a clockwise direction and pushes the shaft of the air cylinder 448 inward against the air pressure in the cylinder, maintaining tension in the dual synchronous belt 436. The air cylinder 448, and the air pressure within the air cylinder, are selected to maintain the tension in the dual synchronous belt 436 within an acceptable range throughout the adjustment range of the idler sprocket 432, without having to alter the air pressure within the air cylinder.

It should be understood that rotating the printing register sprocket 418 from the reference point 5A to the reference point 5B causes the printing plate mounted in alignment with zero timing mark on the print roll 422 to be forced out of synchronism with the feed mechanism and cutting roll 462. Thus, the printing plate will not print the blank, and the cutting die will not cut the blank, at the desired position relative to the leading edge of the blank. Thus, changes in the thickness of the blanks alter somewhat the printing and cutting positions on the blanks. For this reason, the arrangement described with reference to FIG. 16, whereby both the fixed rolls and the adjustable rolls in machine section are driven with a single synchronous belt, is less desirable for printing and cutting applications requiring the highly accurate placement of the printed images and cut shapes on blanks the vary significantly in blank thickness.

Still referring to FIG. 16, in the cutting machine section 404, the synchronous belt sprocket 468 is driven by the output shaft of the second miter gearbox 470. The synchronous belt sprocket 468 drives the dual synchronous belt 476, which drives the synchronous belt sprocket 455, which drives the adjustable lower feed roll 456. The dual synchronous belt 476 also drives the cutting register sprocket 458, which drives cutting register 460, which drives the fixed cutting roll 462. The dual synchronous belt 476 also drives the synchronous belt sprocket 464, which drives the adjustable anvil roll 466. The dual synchronous belt 476 also drives the synchronous belt idler sprocket 472. which is part of the adjustable take-up 474 for the dual synchronous belt 476.

The synchronous belt idler sprocket 472 is rotatably supported by the pivot arm 478. The synchronous belt idler sprocket 472 is located on the slack side of the dual synchronous belt 476. The pivot arm 478 pivots about the pivot pin 480. The air cylinder 486 is pivotably supported by the pin 488 on one end and by the clevis 484 on its opposite end. The clevis 484 is rotatably attached to the pivot arm 478 by the pin 482. The air cylinder 486 is attached to pivot arm 478 opposite the idler sprocket 472 relative to the pivot pin 480. The lower pull roll 456 and the anvil roll 466 are shown adjusted upward to their upper limits by solid lines in the schematic drawing FIG. 16. The air cylinder 486 is partially extended and a predetermined amount of air pressure is applied on the cylinder so as to push the pivot arm 478, thereby causing the idler sprocket 472 to maintain tension in the dual synchronous belt 476.

It will be appreciated that, as indicated by the broken lines in FIG. 16, if lower the pull roll 456, and/or the anvil roll 466, are adjusted downward, the idler sprocket 472 automatically pivots in a counter-clockwise direction and pushes the shaft of the air cylinder 486 inward against the air pressure in the cylinder, maintaining tension in the dual synchronous belt 476. The air cylinder 486, and the air pressure within the air cylinder, are selected to maintain the tension in the dual synchronous belt 476 within an acceptable range throughout the adjustment range of the idler sprocket 472, without having to alter the air pressure within the air cylinder.

Continuing to refer to FIG. 16, the timing mark 6A indicates a point of reference on the synchronous belt sprocket 458 corresponding to the solid line position when the lower pull roll 456 and the anvil roll 466 are shown adjusted upward to their upper limits. The timing mark 6B indicates a point of reference on the synchronous belt sprocket 458 corresponding to the broken line position when the lower pull roll 456 and the anvil roll 466 are shown adjusted downward to their lower position. The adjustment of the lower pull roll 456 and the anvil roll 466 from their upper positions to their lower positions causes the cutting register 460 to rotate through an arc from the reference point 6A to the reference point 6B.

The rotation of cutting register 460 from the reference point 6A to the reference point 6B causes the cutting die mounted in alignment with the zero timing mark on the cutting roll 462 to be forced out of synchronism with the feed mechanism and the print roll 422. Thus, the cutting die will not cut the blank at the desired position relative to the leading edge of the blank. For this reason, the arrangement described with reference to FIG. 16, whereby both the fixed rolls and the adjustable rolls in machine section are driven with a single synchronous belt, is less desirable for printing and cutting applications requiring the highly accurate placement of the printed images and cut shapes on blanks the vary significantly in blank thickness.

In view of the foregoing, it will be appreciated that drive apparatus of the disclosed printer-cutter machine represents a radical departure from conventional printer-cutter machines in that synchronous belts and sprockets are used to drive the machine. The machine includes separate feed/print and cutting machine sections that are contiguous during operation. The machine includes separate synchronous belts for the drive trains of each machine section. Right-angle transmissions and a spline-type coupling allows the machine sections to be separated for maintenance and machine set-up. A synchronous belt arrangement is disclosed in which the fixed rolls and the adjustable rolls of each machine section are driven with separate synchronous belts. Automatic belt take-up mechanisms, driven by air cylinders, for the adjustable rolls of each machine section allow the nip between the upper and lower rolls of each machine section to be adjusted while maintaining constant machine speed and without affecting the proper registration between the machine sections and the leading edge of the paperboard blank. This configuration is suitable for printer-cutter machines requiring highly accurate placement of printed images and cut shapes when the blanks to be processed vary significantly in thickness.

A simpler alternative configuration is described that includes only one synchronous belt for driving both the fixed and adjustable rolls of each machine section. This configuration is suitable for printer-cutter machines requiring less accurate placement of printed images and cut shapes, or application in which the blanks to be processed will not vary significantly in thickness.

Thus, the invention provides a low-cost printer-cutter machine that avoids the costs associated with a gear-driven drive train. The invention also provide a belt-driven printer-cutter machine in which the machine sections may be separated for maintenance and then joined to couple power transmission between the machine sections. And the invention provides a belt-driven printer-cutter machine in which the nip between opposing rolls may be adjusted while maintaining constant machine speed and without affecting the proper registration between the machine sections and the leading edge of the paperboard blank.

While certain embodiments are described above with particularity, these should not be construed as limitations on the scope of the invention, but rather as an example of one preferred embodiment thereof. It should be understood, therefore, that the foregoing relates only to specific embodiments of the invention, and that numerous changes may be made therein without departing from the spirit and scope of the invention as defined by the following claims.

The invention claimed is:

1. A belt-driven machine for operating on a plurality of blanks, each blank defining a leading edge, comprising:

a feed mechanism for feeding each blank in a machine direction;

a first machine section for receiving each blank from the feed mechanism and performing a first operation on each blank;

a first synchronous belt driving the first machine section for synchronizing the performance of the first operation with the position of the leading edge of each blank;

a second machine section for receiving each blank from the first machine section and performing a second operation on each blank;

a second synchronous belt for driving the second machine section; and a separable coupling for selectively transmitting rotational power from the first machine section to the second machine section and for synchronizing the performance of the second operation with the position of the leading edge of each blank.

2. The belt-driven machine of claim 1, further comprising:

a synchronous feed-mechanism belt driving the feed mechanism; and a coupled-set of synchronous belt sprockets synchronously coupling a rotational power source to the synchronous feed-mechanism belt and to the first synchronous belt to synchronize the performance of the first operation with the position of the leading edge of each blank.

3. The belt-driven machine of claim 1, further comprising a separation facilitator for accommodating separation of the first and second machine sections at the separable coupling.

4. The belt-driven machine of claim 3, wherein the separation facilitator comprises free-wheeling rollers supporting a selected one of the machine sections and a linear track for rotatably guiding the rollers to facilitate moving the selected machine section into and out of engagement with the other machine section.

5. The belt-driven machine of claim 3, wherein the separation facilitator comprises:

free-wheeling rollers supporting the first machine section; and a linear track for rotatably guiding the rollers to facilitate moving the first machine section opposite the machine direction to separate the first machine section from the second machine section, and to facilitate moving the first machine section in the machine direction to join the first machine section to the second machine section at the separable coupling.

6. The belt-driven machine of claim 1, wherein one of the operations comprises printing and the other operation comprises cutting.

7. The belt-driven machine of claim 1, wherein:

the first machine section comprises, a rotating first upper roll and an rotating first lower roll defining a first nip for transporting each blank through the first machine section and performing the first operation on each blank, a first adjustment mechanism for adjusting the first nip to accommodate blanks of varying thickness, and a first automatic take-up for automatically maintaining tension in the first synchronous belt in response to adjustment of the first nip; and the second machine section comprises, a rotating second upper roll and a rotating second lower roll defining a second nip for transporting each blank through the second machine section and performing the second operation on each blank, a second adjustment mechanism for adjusting the second nip to accommodate blanks of varying thickness, and a second automatic take-up for automatically maintaining tension in the second synchronous belt in response to adjustment of the second nip.

8. The belt-driven machine of claim 7, wherein:

the first automatic take-up comprises, a first pivoting arm, a first movable tension roller rotatably attached to an end of the first pivoting arm, the first movable tension roller positioned to vary tension in the first synchronous belt as the first pivoting arm pivots, and a first actuator attached to an opposing end of the first pivoting arm for automatically moving the opposing end of the first pivoting arm in response to changes in tension of the first synchronous belt; and the second automatic take-up comprises, a second pivoting arm, a second movable tension roller rotatably attached to an end of the second pivoting arm, the second movable tension roller positioned to vary tension in the second synchronous belt as the second pivoting arm pivots, and a second actuator attached to an opposing end of the second pivoting arm for automatically moving the opposing end of the second pivoting arm in response to changes in tension of the second synchronous belt.

9. The belt-driven machine of claim 8, wherein the first actuator comprises a first air cylinder and the second actuator comprises a second air cylinder.

10. The belt-driven machine of claim 7, wherein the first and second upper rolls and the first and second lower rolls rotate in the machine direction, and the separable coupling rotates in the cross-machine direction, further comprising:

a first right-angle transmission configured to transmit rotational power in the machine direction at a first input shaft to rotational power in the cross-machine direction at a first output shaft, the first input shaft coupled to the first synchronous belt, the first output shaft coupled to the separable coupling, and;

a second right-angle transmission configured to transmit rotational power in the cross-machine direction at a second input shaft to rotational power in the machine direction at a second output shaft, the second input shaft coupled to the separable coupling, the second output shaft coupled to the second synchronous belt.

11. The belt-driven machine of claim 7, wherein the first upper and lower rolls and the second upper and lower rolls are supported by a frame, the first upper roll is adjustable with respect to the frame, the first lower roll is fixed with respect to the frame, the second upper roll is fixed with respect to the frame, the second lower roll is adjustable with respect to the frame, the first synchronous belt drives the first upper roll, and the second synchronous belt drives the second lower roll, further comprising:

a third synchronous belt for driving the fixed first lower roll so that adjustment of the first nip does not alter the position of the first operation with respect to the leading edge of each blank; and a fourth synchronous belt for driving the fixed second upper roll so that adjustment of the second nip does not alter the position of the second operation with respect to the leading edge of each blank.

12. The belt-driven machine of claim 11, wherein the first and second upper rolls and the first and second lower rolls rotate in the machine direction, and the separable coupling rotates in the cross-machine direction, further comprising:

a first right-angle transmission configured to transmit rotational power in the machine direction at a first input shaft to rotational power in the cross-machine direction at a first output shaft, the first input shaft coupled to the third synchronous belt, the first output shaft coupled to the separable coupling;

a second right-angle transmission configured to transmit rotational power in the cross-machine direction at a second input shaft to rotational power in the machine direction at a second output shaft and to rotational power in the cross-machine direction at a third output shaft, the second input shaft coupled to the separable coupling, the second output shaft coupled to the second synchronous belt; and a third right-angle transmission configured to transmit rotational power in the cross-machine direction at a third input shaft to rotational power in the machine direction at a fourth output shaft, the third input shaft coupled to the third output shaft, the fourth output shaft coupled to the fourth synchronous belt.

13. The belt-driven machine of claim 12, further comprising:

a first upper synchronous sprocket coupling the first synchronous belt to the first upper roll;

a first lower synchronous sprocket coupling the third synchronous belt to the first lower roll;

a second upper synchronous sprocket coupling the fourth synchronous belt to the second upper roll;

a second lower synchronous sprocket coupling the second synchronous belt to the second lower roll;

a dual synchronous sprocket coupling the rotational power source to the first synchronous belt and to the synchronous feed-mechanism belt, the dual synchronous sprocket defining an equal number of belt-engaging teeth for engaging the first synchronous belt and the synchronous feed-mechanism belt;

a third synchronous sprocket coupling the synchronous feed-mechanism belt to the feed mechanism;

the first lower, second upper, second lower, and third synchronous sprockets each defining an equal number of belt-engaging teeth; and the first, second, and third right-angle transmissions each having a one-to-one input-to-output rotation ratio.

14. The belt-driven machine of claim 12, wherein the first upper roll is an impression roll, the first lower roll is a print roll, the second upper roll is a cutting roll, and the second lower roll is an anvil roll, further comprising:

an upper feed roll driven by the first synchronous belt;

a lower feed roll driven by the first synchronous belt; and a third nip defined by the upper feed roll and the lower feed roll for transporting each blank from the feed mechanism to the first nip.

15. The belt-driven machine of claim 12, further comprising:

a lower pull roll driven by the second synchronous belt;

an upper pull roll driven by the fourth synchronous belt; and a fourth nip defined by the upper pull roll and the lower pull roll for transporting each blank from the first nip to the second nip.

16. A belt-driven machine for operating on a plurality of blanks, each blank defining a leading edge, comprising:

a first machine section comprising, a rotating first upper roll and an rotating first lower roll defining a first nip for transporting each blank through the first machine section and performing the first operation on each blank, a first synchronous belt driving the first machine section for synchronizing the performance of the first operation with the position of the leading edge of each blank, a first adjustment mechanism for adjusting the first nip to accommodate blanks of varying thickness, and a first automatic take-up for automatically maintaining tension in the first synchronous belt in response to adjustment of the first nip; and a second machine section comprising, a rotating second upper roll and a rotating second lower roll defining a second nip for transporting each blank through the second machine section and performing the second operation on each blank, a second synchronous belt driving the second machine section for synchronizing the performance of the second operation with the position of the leading edge of each blank, a second adjustment mechanism for adjusting the second nip to accommodate blanks of varying thickness, and a second automatic take-up for automatically maintaining tension in the second synchronous belt in response to adjustment of the second nip.

17. The belt-driven machine of claim 16, wherein one of the operations comprises printing and the other operation comprises cutting.

18. The belt-driven machine of claim 16, wherein the first operation comprises printing and the second operation comprises cutting.

19. The belt-driven machine of claim 16, wherein:

the first automatic take-up comprises, a first pivoting arm, a first movable tension roller rotatably attached to an end of the first pivoting arm, the first movable tension roller positioned to varying tension in the first synchronous belt as the first pivoting arm pivots, and a first actuator attached to an opposing end of the first pivoting arm for automatically moving the opposing end of the first pivoting arm in response to changes in tension of the first synchronous belt; and the second automatic take-up comprises, a second pivoting arm, a second movable tension roller rotatably attached to an end of the second pivoting arm, the second movable tension roller positioned to vary tension in the second synchronous belt as the second pivoting arm pivots, and a second actuator attached to an opposing end of the second pivoting arm for automatically moving the opposing end of the second pivoting arm in response to changes in tension of the second synchronous belt.

20. The belt-driven machine of claim 19, wherein the first upper and lower rolls and the second upper and lower rolls are supported by a frame, the first upper roll is adjustable with respect to the frame, the first lower roll is fixed with respect to the frame, the second upper roll is fixed with respect to the frame, the second lower roll is adjustable with respect to the frame, the first synchronous belt drives the first upper roll, and the second synchronous belt drives the second lower roll, further comprising:

a third synchronous belt for driving the fixed first lower roll so that adjustment of the first nip does not alter the position of the first operation with respect to the leading edge of each blank; and a fourth synchronous belt for driving the fixed second upper roll so that adjustment of the second nip does not alter the position of the second operation with respect to the leading edge of each blank.

21. The belt-driven machine of claim 20, wherein the first and second upper rolls and the first and second lower rolls rotate in the machine direction, and the separable coupling rotates in the cross-machine direction, further comprising:

a first right-angle transmission configured to transmit rotational power in the machine direction at a first input shaft to rotational power in the cross-machine direction at a first output shaft, the first input shaft coupled to the third synchronous belt, the first output shaft coupled to the separable coupling;

a second right-angle transmission configured to transmit rotational power in the cross-machine direction at a second input shaft to rotational power in the machine direction at a second output shaft and to rotational power in the cross-machine direction at a third output shaft, the second input shaft coupled to the separable coupling, the second output shaft coupled to the second synchronous belt; and a third right-angle transmission configured to transmit rotational power in the cross-machine direction at a third input shaft to rotational power in the machine direction at a fourth output shaft, the third input shaft coupled to the third output shaft, the fourth output shaft coupled to the fourth synchronous belt.

22. The belt-driven machine of claim 21, wherein the first upper roll is an impression roll, the first lower roll is a print roll, the second upper roll is a cutting roll, and the second lower roll is an anvil roll, further comprising:

an upper feed roll driven by the first synchronous belt;

a lower feed roll driven by the first synchronous belt;

a third nip defined by the upper feed roll and the lower feed roll for transporting each blank from the feed mechanism to the first nip;

a synchronous feed-mechanism belt driving the feed mechanism;

a coupled-set of synchronous belt sprockets synchronously coupling the rotational power source to the first synchronous belt and the synchronous feed-mechanism belt;

a lower pull roll driven by the second synchronous belt;

an upper pull roll driven by the fourth synchronous belt; and a fourth nip defined by the upper pull roll and the lower pull roll for transporting each blank from the first nip to the second nip.

23. A belt-driven machine for operating on a plurality of blanks, each blank defining a leading edge, comprising:

a feed mechanism coupled to a rotational power source for feeding the blanks in a machine direction;

a synchronous feed-mechanism belt driving the feed mechanism;

a first machine section comprising, a first frame;

a rotating first upper roll and an rotating first lower roll defining a first nip for transporting each blank through the first machine section and performing a first operation on each blank, a first adjustment mechanism for adjusting the position of the first upper roll with respect to the first frame to adjust the first nip to accommodate blanks of varying thickness, a first synchronous belt driving the first upper roll, a third synchronous belt driving the first lower roll so that adjustment of the first nip does not alter the position of the first operation with respect to the leading edge of each blank, and a first automatic take-up for automatically maintaining tension in the first synchronous belt in response to adjustment of the first nip;

a coupled-set of synchronous belt sprockets synchronously coupling the rotational power source to the synchronous feed-mechanism belt and to the first synchronous belt to synchronize the performance of the first operation with the position of the leading edge of each blank;

a second machine section comprising, a second frame;

a rotating second upper roll and a rotating second lower roll defining a second nip for transporting each blank through the second machine section and performing the second operation on each blank, a second adjustment mechanism for adjusting the position of the second lower roll to adjust the second nip to accommodate blanks of varying thickness, a second synchronous belt driving the second lower roll, a fourth synchronous belt driving the second upper roll so that adjustment of the second nip does not alter the position of the second operation with respect to the leading edge of each blank, and a second automatic take-up for automatically maintaining tension in the second synchronous belt in response to adjustment of the second nip;

a separable coupling for rotating in the cross-machine direction to selectively transmit rotational power from the first machine section to the second machine section and to synchronize the performance of the second operation with the position of the leading edge of each blank;

a first right-angle transmission configured to transmit rotational power in the machine direction at a first input shaft to rotational power in the cross-machine direction at a first output shaft, the first input shaft coupled to the third synchronous belt, the first output shaft coupled to the separable coupling;

a second right-angle transmission configured to transmit rotational power in the cross-machine direction at a second input shaft to rotational power in the machine direction at a second output shaft and to rotational power in the cross-machine direction at a third output shaft, the second input shaft coupled to the separable coupling, the second output shaft coupled to the second synchronous belt;

a third right-angle transmission configured to transmit rotational power in the cross-machine direction at a third input shaft to rotational power in the machine direction at a fourth output shaft, the third input shaft coupled to the third output shaft, the fourth output shaft coupled to the fourth synchronous belt; and a separation facilitator for accommodating separation of the first and second machine sections at the separable coupling.

* * * * *